US006683575B2

(12) United States Patent
Sekine et al.

(10) Patent No.: US 6,683,575 B2
(45) Date of Patent: Jan. 27, 2004

(54) ANTENNA APPARATUS

(75) Inventors: Syuichi Sekine, Yokohama (JP); Takayoshi Ito, Yokohama (JP); Yasushi Murakami, Yokohama (JP); Hiroki Shoki, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/188,755

(22) Filed: Jul. 5, 2002

(65) Prior Publication Data

US 2003/0006937 A1 Jan. 9, 2003

(30) Foreign Application Priority Data

Jul. 5, 2001 (JP) ..... 2001-205239
Dec. 5, 2001 (JP) ..... 2001-371772

(51) Int. Cl.[7] ..... H01Q 1/24
(52) U.S. Cl. ..... 343/702; 343/700 MS
(58) Field of Search ..... 343/702, 700 MS, 343/725, 726, 729, 742, 793; H01Q 1/24, 1/38

(56) References Cited

U.S. PATENT DOCUMENTS 5,644,319 A * 7/1997 Chen et al. ..... 343/702
5,917,450 A * 6/1999 Tsunekawa et al. .. 343/700 MS
5,926,139 A * 7/1999 Korisch ..... 343/702
5,936,583 A * 8/1999 Sekine et al. ..... 343/702
6,114,996 A * 9/2000 Nghiem ..... 343/700 MS
6,147,652 A * 11/2000 Sekine ..... 343/702
6,166,694 A * 12/2000 Ying ..... 343/702
6,333,714 B1 * 12/2001 Takahashi ..... 343/700 MS
6,346,914 B1 * 2/2002 Annamaa ..... 343/700 MS

OTHER PUBLICATIONS

Shuichi Sekine, et al. "Disc–Loaded Folded Monopole Antenna with Matching Plate", IEICE Trans., vol. J71–B, No. 11, Nov. 1988, pp. 1248–1251.

Takayuki Ishizone, et al. "Impedance characteristics of Inverted–F Antenna with Matching Plate", Faculty of Engineering, Tohoku University, IEICE National General Conference in Japan (No. 675), 1986, p. 3–112 (one page).

* cited by examiner

*Primary Examiner*—Hoanganh Le
(74) *Attorney, Agent, or Firm*—Oblon, Spivak, McClelland, Maier & Neustadt, P.C.

(57) ABSTRACT

An antenna apparatus is constituted by first, second, third, and fourth wire antenna elements and a connection element. The sum of the lengths of the first, second, and fourth wire antenna elements is ¼ the wavelength corresponding to a series-resonance frequency of the first, second, and fourth wire antenna elements. The sum of the lengths of the second, third, and fourth wire antenna elements is ½ the wavelength corresponding to a parallel-resonance frequency of the second, third, and fourth wire antenna elements. The sum of the lengths of the first and third wire antenna elements is ¼ the wavelength corresponding to a series-resonance frequency of the first and third wire antenna elements. The parallel-resonance frequency is higher than the series-resonance frequency of the first, second, and fourth wire antenna elements and lower than the series-resonance frequency of the first and third wire antenna elements.

23 Claims, 18 Drawing Sheets

$\lambda 2 < \lambda 3 < \lambda 1$
$f1 < f3 < f2$

ANTENNA APPARATUS

CROSS-REFERENCE TO RELATED APPLICATIONS

This application is based upon and claims the benefit of priority from the prior Japanese Patent Applications No. 2001-205239, filed Jul. 5, 2001; and No. 2001-371772, filed Dec. 5, 2001 the entire contents of both of which are incorporated herein by reference.

BACKGROUND OF THE INVENTION

1. Field of the Invention

The present invention relates to an antenna apparatus used as antenna mounted on a surface of a vehicle or used as a built-in antenna for a portable telephone or the like.

2. Description of the Related Art

The antenna of a portable telephone suffers a changeable frequency characteristic depending on the proximity of the user's body or the like. To mitigate the change, the antenna of a portable telephone must be broadband.

An antenna shown in FIG. 1 is a conventional antenna. The antenna is a built-in antenna which is set on one surface, i.e., ground plane 100 of a square internal housing 101 made of a ground conductor (ground plane) inside an external housing made of an insulator such as a plastic in a wireless communication device. This antenna is constituted by a planar inverted-F antenna made up of a first and second planar antenna elements 104 and 105, and a third planar antenna element 106 interposed between the ground plane 100 and the second planar antenna element 105. The second planar antenna element 105 is connected to a feed line 103 at a node 111, whereas the third planar antenna element 106 is connected to the feed line 103 at a node 112.

A radio circuit 113 is connected to the feed point 102 and transmits and receives a radio wave via the first, second, and third planar antenna elements 104, 105, and 106.

The antenna shown in FIG. 1 serves as a broadband antenna by adding the third planar antenna element 106 to the planar inverted-F antenna. This antenna, which occupies a wide area in mounting and is difficult to design, was reported by the present inventor (No. 675) in the 1986 IEICE National General Conference in Japan.

In recent years, terminals such as for wireless communication devices are being downsized for progressing its portability. Demands have arisen for a small structure in which an antenna as shown in FIG. 1 is mounted on a circuit board and parts are mounted immediately below a planar antenna element. However, the antenna shown in FIG. 1 has two, third and second, planar antenna elements, which poses limitations on downsizing of parts mounted on the circuit board 100.

The antenna shown in FIG. 1 requires a long time for design. This antenna comprises the first, second, and third planar antenna elements 104, 105, and 106. The widths and heights of the first, second, and third planar antenna elements 104, 105, and 106, and their area which is the product of the widths and heights are included in parameters which determine the frequency characteristic of the antenna. Correlation parameters between the first, second, and third planar antenna elements 104, 105, and 106 cannot be ignored. A model to be input to an electromagnetic simulation is difficult to formulate. For an experimental approach, many parameters must be taken into consideration. It takes a long time to optimize the dimension values of the structure. Since the design guideline values of the antenna have not been determined, desired broadband characteristics are very difficult to obtain. As described above, in a conventional broadband planar inverted-F antenna as shown in FIG. 1, an unnecessary mounting area and design difficulty are left unsolved.

BRIEF SUMMARY OF THE INVENTION

It is an object of the present invention to provide an antenna apparatus which is easy to design and ensures a wide part mounting area.

According to an aspect of the present invention, there is provided an antenna apparatus comprising a feed point, a first linear antenna element, a second linear antenna element, a third linear antenna element, a fourth linear antenna element, and a connection element, wherein one end of the first linear antenna element is connected to the feed point, one end of the second linear antenna element is connected to the other end of the first linear antenna element, one end of the third linear antenna element is connected to the other end of the first linear antenna element, one end of the fourth linear antenna element is connected to the other end of the second linear antenna element, the connection element connects the other end of the second linear antenna element and a ground terminal, the third and fourth linear antenna elements are arranged parallel to each other, a sum of lengths of the first, second, and fourth linear antenna elements is ¼ a wavelength corresponding to a series-resonance frequency of the first, second, and fourth linear antenna elements, a sum of lengths of the second, third, and fourth linear antenna elements is ½ a wavelength corresponding to a parallel-resonance frequency of the second, third, and fourth linear antenna elements, a sum of lengths of the first and third linear antenna elements is ¼ a wavelength corresponding to a parallel-resonance frequency of the first and third linear antenna elements, and the parallel-resonance frequency is higher than a frequency of the series-resonance frequency of the first, second, and fourth linear antenna elements and lower than the series-resonance frequency of the first and third linear antenna elements.

According to another aspect of the present invention, there is provided an antenna apparatus comprising a feed point, a first linear antenna element, a second linear antenna element, a third linear antenna element, and a connection element, wherein one end of the first linear antenna element is connected to the feed point, one end of the second linear antenna element is connected to the other end of the first linear antenna element, one end of the third linear antenna element is connected to the other end of the first linear antenna element, the connection element which connects the other end of the first linear antenna element and a ground terminal, a sum of lengths of the first and third linear antenna elements is ¼ a wavelength corresponding to the series-resonance frequency of the first and third linear antenna elements, a sum of lengths of the second and third linear antenna elements is ½ a wavelength corresponding to the parallel-resonance frequency of the second and third linear antenna elements, a sum of lengths of the first and second linear antenna elements is ¼ a wavelength corresponding to a series-resonance frequency of the first and second linear antenna elements, and the parallel-resonance frequency is higher than a frequency of the series-resonance frequency of the first and third linear antenna elements and lower than the series-resonance frequency of the first and second linear antenna elements.

According to another aspect of the present invention, there is provided an antenna apparatus comprising a feed point, a first linear antenna element, a second linear antenna element, a third linear antenna element, and a connection element, wherein one end of the first linear antenna element is connected to the feed point, one end of the second linear antenna element is connected to the other end of the first linear antenna element, one end of the third linear antenna element is connected to the other end of the second linear antenna element, the connection element which connects the other end of the second linear antenna element and a ground terminal, a sum of lengths of the first, second, and third linear antenna elements is ¼ a wavelength corresponding to the series-resonance frequency of the first, second, and third linear antenna elements, a sum of lengths of the second and third linear antenna elements is ½ a wavelength corresponding to the parallel-resonance frequency of the second and third linear antenna elements, a sum of lengths of the first linear antenna elements is ¼ a wavelength corresponding to the series-resonance frequency of the first linear antenna elements, and the parallel-resonance frequency is higher than a frequency of the series-resonance frequency of the second and third linear antenna elements and lower than the series-resonance frequency of the first linear antenna element.

According to another aspect of the present invention, there is provided an antenna apparatus comprising a feed point and first to sixth linear antenna elements, and connection element, wherein one end of the first linear antenna element is connected to the feed point, one end of the second linear antenna element is connected to the other end of the first linear antenna element, one end of the third linear antenna element is connected to the other end of the first linear antenna element, one end of the fourth linear antenna element is connected to the other end of the first linear antenna element, the connection element which connects the other end of the second linear antenna element and a ground terminal, one end of the fifth linear antenna element is connected to the other end of the second linear antenna element, one end of the sixth linear antenna element is connected to the other end of the second linear antenna element, a division line which halves an angle defined by the third and fourth linear antenna elements and a division line which halves an angle defined by the fifth and sixth linear antenna elements are adjusted to the same direction, lengths of the third and fourth linear antenna elements are equal to each other, and lengths of the fifth and sixth linear antenna elements are equal to each other.

Parameters concerning the design of the antenna can be calculated based on the lengths of the respective linear antenna elements which constitute the antenna apparatus. Hence, the antenna apparatus is designed more easily than a conventional one.

As parts which constitute the antenna apparatus, linear antenna elements are used instead of conventional planar antenna elements, reducing the space necessary for mounting. A device which holds the antenna apparatus can be downsized in comparison with a conventional device.

DETAILED DESCRIPTION OF THE INVENTION

Embodiments of the present invention will be described in detail below with reference to the several views of the accompanying drawing.

(First Embodiment)

Figure 2:
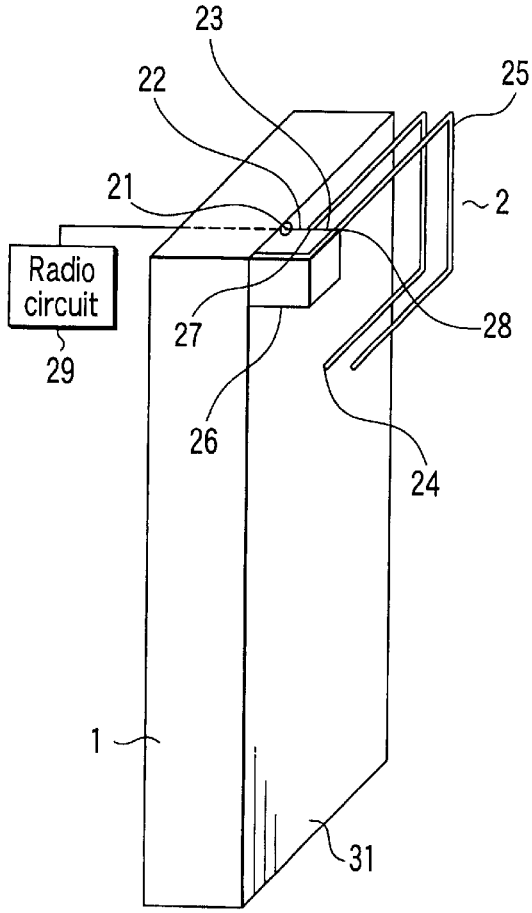
FIG. 2 is a view showing an arrangement of an antenna 2 according to a first embodiment of the present invention.

FIG. 2 shows an arrangement of an antenna 2 according to the first embodiment of the present invention.

The antenna 2 according to the first embodiment is installed in a square internal housing 1 formed from a ground conductor inside an external housing made of an insulator such as a plastic in a wireless communication device. A surface on which the antenna 2 of the housing 1 is mounted will be called a ground plane 31. The antenna 2 exchanges signals with a wireless device via a feed point 21 on the housing 1 so as not to electrically connect the antenna 2 and ground plane 31.

The shape and size of the housing 1 are not particularly limited and can be arbitrarily designed. The feed point 21 can be set at an arbitrary position on the housing 1. In FIG. 2, the feed point 21 is set at the end of the ground plane 31 of the housing 1. However, the following effects can be obtained by adjustment regardless of where the feed point 21 is set on the housing 1.

The antenna 2 shown in FIG. 2 is constituted by first, second, third, and fourth wire antenna elements 22, 23, 24, and 25, and an inverse L-shaped planar element 26.

A radio circuit 29 is connected to the feed point 21 and transmits and receives a radio wave via the first, second, third, and fourth wire antenna elements 22, 23, 24, and 25.

The first, second, third, and fourth wire antenna elements 22, 23, 24, and 25 can take any shape as far as these antenna elements are linear.

In this case, a planar element 26 is not limited to the plate shape and can be formed from a linear antenna element or the like.

As shown in FIG. 2, the first wire antenna element 22 of the antenna 2 has one end connected to the feed point 21, and is arranged almost perpendicularly to the ground plane 31. The third wire antenna element 24 has one end connected to the other end of the first wire antenna element 22, and is arranged almost parallel to the ground plane 31. A node 27 between the first and third wire antenna elements 22 and 24 is connected to one end of the second wire antenna element 23, which is arranged parallel to the first wire antenna element 22. The other end of the second wire antenna element 23 is connected to one end of the fourth wire antenna element 25, which is arranged almost parallel to the third wire antenna element 24. The planer element 26 connects the other end of the second linear antenna element 23 and a ground plane 31. A node 28 between the fourth and second wire antenna elements 25 and 23 is connected to the top plane of the inverse L-shaped planer element 26. The wire antenna elements 24 and 25 are bent into a U shape and arranged almost parallel to each other.

In terms of the operation of the antenna, the antenna 2 comprises a series-resonant antenna made up of a feed line formed from the first and second linear elements 22 and 23, the first, second, and fourth wire antenna element and the planer element 22, 23, 25, and 26, and a parallel-resonant antenna made up of the feed line, the second, third, and fourth wire antenna elements 23, 24, and 25.

Figure 3:
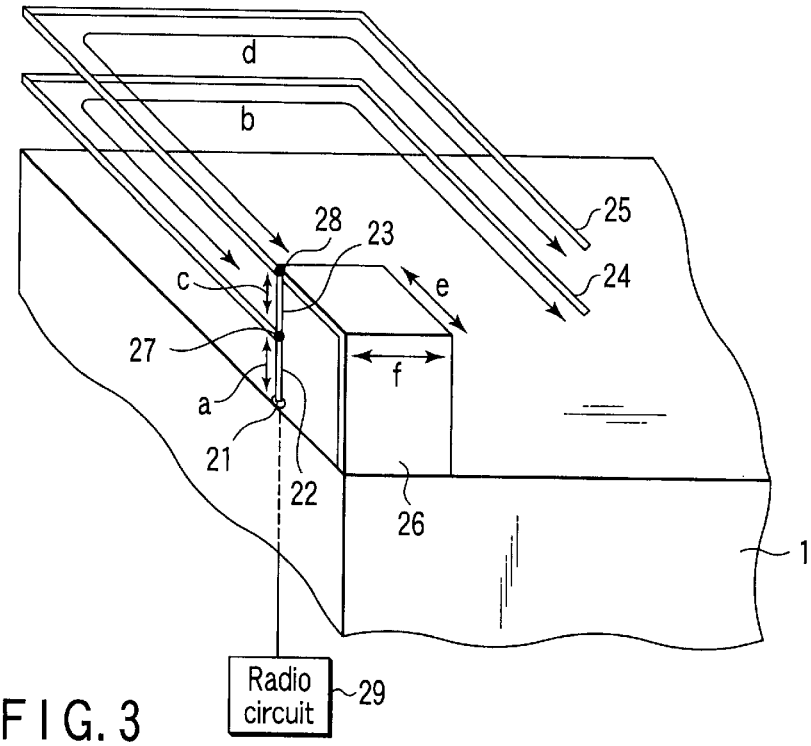
FIG. 3 is a view for explaining in more detail an arrangement in terms of a operation of the antenna 2 shown in FIG. 2.

FIG. 3 is a view for explaining in more detail an arrangement in terms of the operation of the antenna 2 in FIG. 2. Design parameters a to f of respective antenna elements are also illustrated in FIG. 3.

The design parameters a to d shown in FIG. 3 correspond to the lengths of the first, third, second, and fourth wire antenna elements 22, 24, 23, and 25. The design parameters e and f correspond to the width and depth of the planar element 26.

The design parameters a to f are all the parameters concerning the frequency characteristic of the antenna 2. By determining the six parameters, the frequency characteristic of the antenna 2 can be determined.

The series-resonant antenna refers to a first series-resonant antenna hereinafter.

The antenna 2 comprises a second series-resonant antenna made up of the feed line, the first, and third wire antenna element and the planer element 22, 24, and 26.

As described above, the antenna 2 is formed from a combination of the first and second series-resonant antennas and parallel resonant antenna. The sum of the lengths of the first, second, and fourth wire antenna elements 22, 23, and 25 is ¼ the wavelength corresponding to the resonance frequency of the first series-resonant antenna. The sum of the lengths of the second, third, and fourth wire antenna elements 23, 24, and 25 is ½ the wavelength corresponding to the resonance frequency of the parallel-resonant antenna.

Figure 4A:
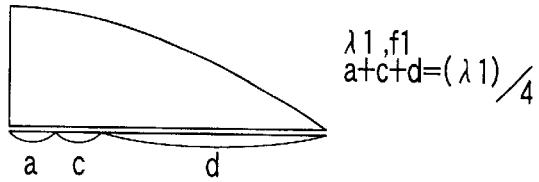
FIG. 4A is a view showing a condition which must be satisfied by a first series resonant antenna in an antenna 2 shown in FIG. 2.

FIG. 4A is a view showing a condition which must be satisfied by the first series-resonant antenna in the antenna 2 shown in FIG. 2.

Figure 4B:
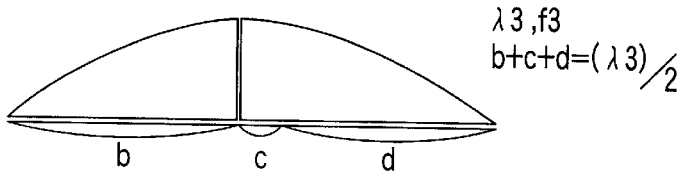
FIG. 4B is a view showing a condition which must be satisfied by a parallel resonant antenna in the antenna 2 shown in FIG. 2.

FIG. 4B is a view showing a condition which must be satisfied by the parallel resonant antenna in the antenna 2 shown in FIG. 2.

Figure 4C:
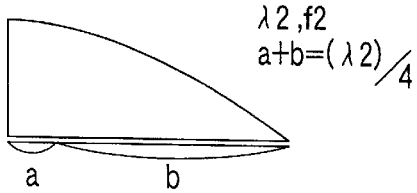
FIG. 4C is a view showing a condition which must be satisfied by a second series resonant antenna in the antenna 2 shown in FIG. 2.

FIG. 4C is a view showing a condition which must be satisfied by the second series resonant antenna in the antenna 2 shown in FIG. 2.

As shown in FIG. 3, let a be the length of the first wire antenna element 22 which connects the feed point 21 and node 27; b, the length of the third wire antenna element 24 having one end connected to the node 27; c, the length of the second wire antenna element 23 which connects the nodes 27; and d, the length of the fourth wire antenna element 24 having one end connected to the node 28. Then, as shown in FIG. 4A, the sum (a+c+d) of the lengths of the first, second, and fourth wire antenna elements 22, 23, and 25 is ¼ a wavelength λ1, i.e., (¼)λ1 corresponding to the resonance frequency of the first series-resonant antenna. As shown in FIG. 4B, the sum (b+c+d) of the lengths of the second, third, and fourth wire antenna elements 23, 24, and 25 is ½ a wavelength λ3, i.e., (½)λ3 corresponding to the resonance frequency of the parallel-resonant antenna.

The height of the first series-resonant antenna is determined by the sum of the values a and c, and determines the transmission/reception frequency bandwidth of the antenna 2. To widen the bandwidth of the antenna 2 as much as possible, the height (a+c) of the antenna 2 is set as large as possible.

The value a must meet the following condition:

$$(c-b+d)/2>a>(b-c-d)/2 \quad (1)$$

Inequality (1) is a conditional expression for generating parallel resonance in the antenna 2.

Parallel resonance in the antenna 2 is generated from antenna elements in two series resonant antenna of the antenna 2. One of the two series resonant antenna: a first series resonant antenna is an antenna with a length (a+c+d=(λ1)/4) that is made up of the first, second, and fourth wire antenna elements 22, 23, and 25 (see FIG. 4A). Another of the two series resonant antenna: a second series resonant antenna is an antenna with a length (a+b=(λ2)/4) that is made up of the first and third wire antenna elements 22 and 24 (see FIG. 4C).

In this case, f1 represents the resonant frequency of the first series resonant antenna (λ1 is the wavelength corresponding to the resonant frequency f1); and f2, the resonant frequency of the second series resonant antenna (λ2 is the wavelength corresponding to the resonant frequency f2).

At this time, the resonant frequencies f1 and f2 of the first and second series resonant antennas must be different from each other. This is the first condition for generating parallel resonance in the antenna 2.

A resonant frequency f3 (λ3 is the wavelength corresponding to the resonant frequency f3) of the parallel resonant antenna (see FIG. 4B) with a length b+c+d=λ3/2 that is made up of the second, third, and fourth wire antenna elements 23, 24, and 25 must be higher than the resonant frequency f1 and lower than the resonant frequency f2. This is the second parallel resonance generation condition. That is, $$f1<f3<f2 \quad (2)$$

Inequality (2) is rewritten by wavelengths:

$$\lambda 2<\lambda 3<\lambda 1 \quad (3)$$

This is the second parallel resonance generation condition.

Substituting $$a+c+d=\lambda 1/4$$

$$b+c+d=\lambda 3/2$$

$$a+b=\lambda 2/4$$

into inequality (3) yields $$4(a+b)<2(b+c+d)<4(a+c+d) \quad (4)$$

By modifying inequality (4), inequality (1) can be obtained.

Figure 1:
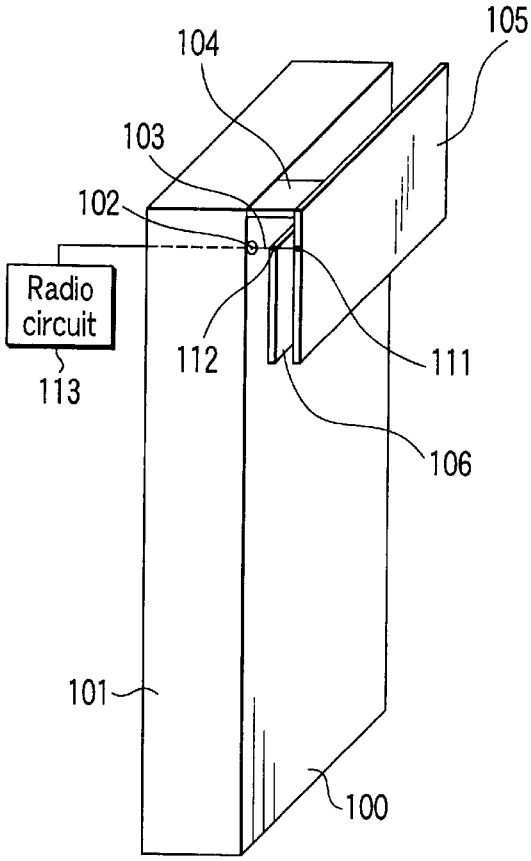
FIG. 1 PRIOR ART
FIG. 1 is a view for explaining the arrangement of a conventional antenna.

The antenna 2 can be easily constituted by mainly setting the parameter values a to f. However, the conventional antenna having the arrangement as shown in FIG. 1 uses a planar antenna element, and such parameters cannot be easily set.

The necessity of parallel resonance at the resonant frequency f3 (wavelength λ3 corresponding to the resonant frequency f3) has not been mentioned yet. This is one of the features of the present invention, and is not different from merely a design value.

A method of determining the parameter values a to f of the antenna 2 having the arrangement as shown in FIG. 3 will be explained.

Procedures of determining the parameter values of the antenna 2 with a resonant frequency f1 of almost 860 MHz, a resonant frequency f2 of almost 900 MHz, and a resonant frequency f3 of almost 880 MHz will be described.

In the following description, the parameter values b, c, and d are respectively set to 80 mm, 5 mm, and 86 mm in consideration of the size of the housing 1 which stores the antenna 2.

A method of determining the parameter value a will be described with reference to FIGS. 5, 6A, and 6B.

Figure 5:
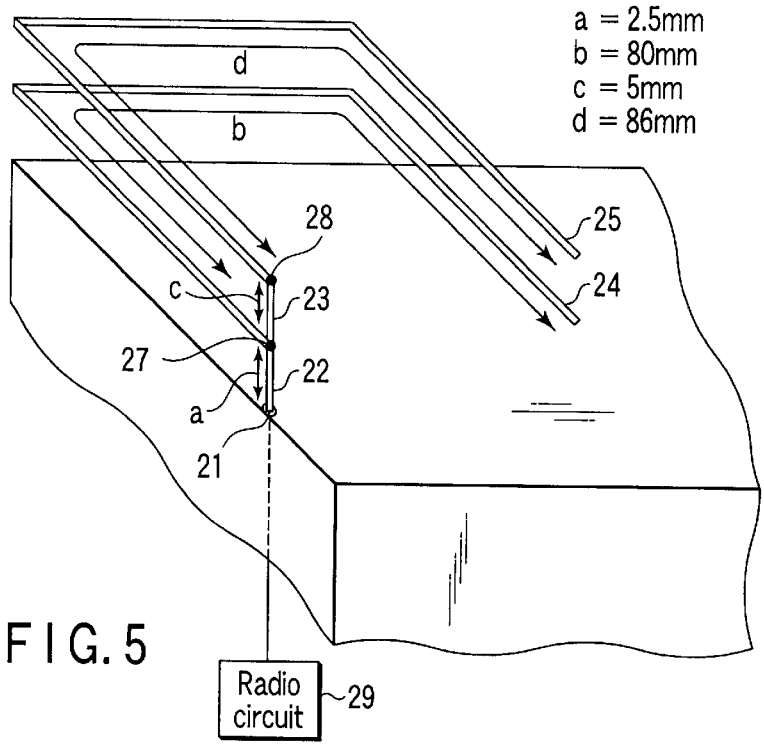
FIG. 5 is a view for explaining a method of determining a parameter a of the antenna 2 shown in FIG. 2, and showing the arrangement of the parallel resonant antenna when a planar element 26 is removed from the antenna 2.

FIG. 5 is a view showing the arrangement of the parallel resonant antenna when the planar element 26 is removed from the antenna 2 having the arrangement shown in FIG. 3.

The value a must be adjusted by referring to the impedance of the parallel resonant antenna having the arrangement shown in FIG. 5. In other words, the impedance of the parallel resonant antenna having the arrangement shown in FIG. 5 can be adjusted by adjusting the value a.

Figure 6A:
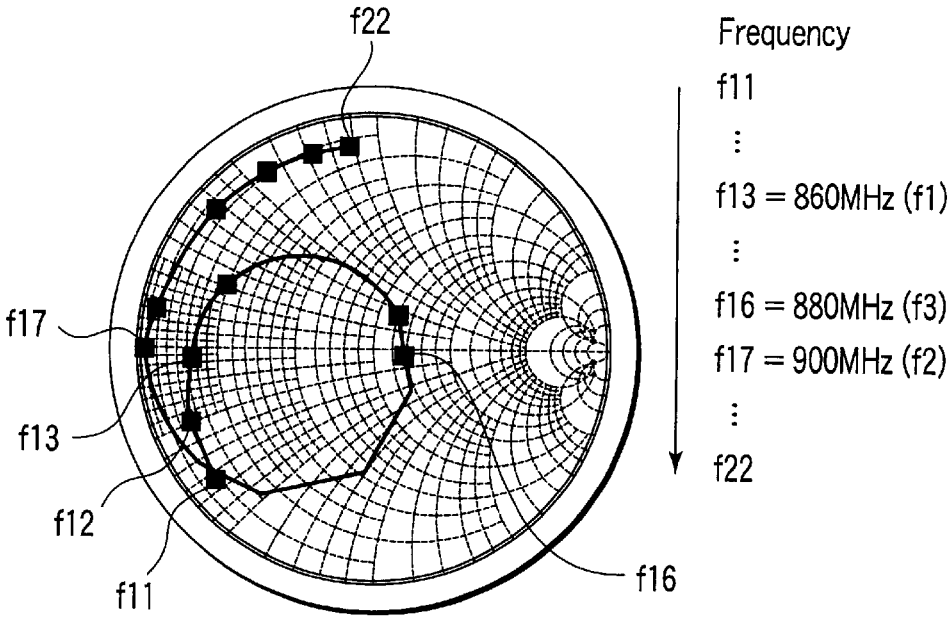
FIG. 6A is a Smith chart showing a change in the impedance of the parallel resonant antenna when a radio frequency signal is supplied from a feed point 21 of the parallel resonant antenna shown in FIG. 5 while the frequency is changed.

FIG. 6A is a Smith chart showing a change in the impedance of the parallel resonant antenna when a radio frequency signal is supplied from the feed point 21 of the parallel resonant antenna shown in FIG. 5 while the frequency is changed.

Figure 6B:
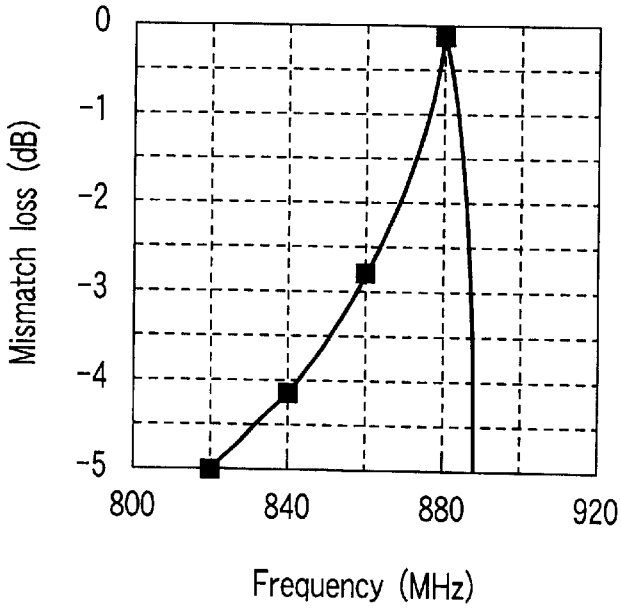
FIG. 6B is a graph showing a change in the mismatch loss of the parallel resonant antenna when a radio frequency signal is supplied from the feed point 21 of the parallel resonant antenna shown in FIG. 5 while the frequency is changed.

FIG. 6B is a graph showing a change in the mismatch loss of the parallel resonant antenna when a radio frequency signal is supplied from the feed point 21 of the parallel resonant antenna shown in FIG. 5 while the frequency is changed.

The frequency shown in FIG. 6B, i.e., the frequency signal (input frequency signal) supplied from the feed point 21 of the antenna 2 gradually increases the value from a frequency f11 to a frequency f22. A frequency f13 is 860 MHz (frequency corresponding to f1); f16, 880 MHz (frequency corresponding to f3); and f17, 900 MHz (frequency corresponding to f2).

The parameter value a is adjusted by referring to the Smith chart as shown in FIG. 6A such that the reactance of the parallel resonant antenna having the arrangement shown in FIG. 5 is "0" when the frequency of the input frequency signal is f1, f3, or f2, and that the mismatch loss is almost "0" at the frequency f3.

At a parameter value a of almost 2.5 mm, the locus of the impedance of the parallel resonant antenna having the arrangement as shown in FIG. 5 along with a change in the frequency of the input frequency signal changes to draw a loop midway along the locus as the frequency increases, as shown in FIG. 6A. At frequencies f13, f16, and f17 of the input radio frequency signal corresponding to the frequencies f1, f3, and f2, the reactance is "0". The mismatch loss is almost "0" at 880 MHz corresponding to f3, as shown in FIG. 6B. This means that the antenna 2 operates in parallel resonance at an input frequency of almost 880 MHz.

The parameter value a determines the dominance of the parallel resonant antenna over the first and second series resonant antennas. Two current distributions of parallel resonance and series resonance exist over each other on the antenna 2. The dominance of the parallel resonant antenna corresponds to the ratio between the amplitudes of these distributions. As the parameter a is smaller, the parallel resonance current increases. By adjusting the parameter value a, the impedance can be adjusted.

After the parameter value a is determined, the shape of the planar element 26 is determined.

A method of determining the parameters e and f which determine the shape of the planar element 26 will be described with reference to FIGS. 7, 8A, and 8B.

Figure 7:
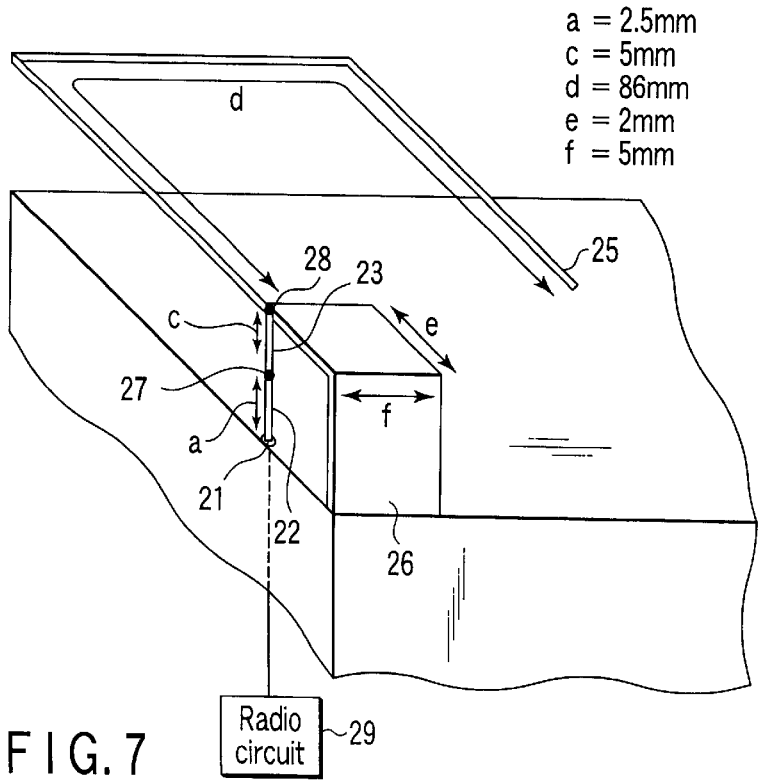
FIG. 7 is a view for explaining a method of determining parameters e and f (and d if necessary) of the antenna 2 shown in FIG. 2, and showing the arrangement of the first series resonant antenna when a wire antenna element 24 is removed from the antenna 2.

FIG. 7 is a view showing the arrangement of the first series resonant antenna when the wire antenna element 24 is removed from the antenna 2 having the arrangement shown in FIG. 3.

In FIGS. 2 and 3, the other end of the planar element 26 that is not connected to the ground plane 31 is bent into an L shape so as to face the ground plane 31 (housing 1). The planar element 26 is not limited to this shape, and suffices to have one end connected to the ground plane 31 and the other end connected to the node 28 between the fourth and second wire antenna elements 25 and 23.

Figure 9:
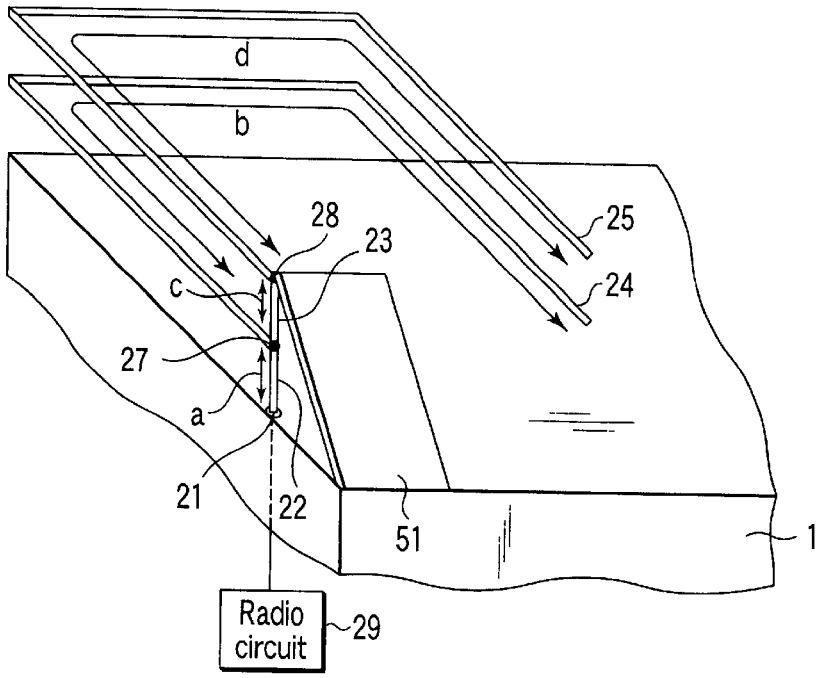
FIG. 9 is a view showing another arrangement of the antenna 2 shown in FIG. 2 when the planar element 26 is replaced by the planar element 51.

In short, the planar element 26 takes any shape as far as the planar element 26 connects the node 28 and ground plane 31 (ground (GND)) and has the following frequency characteristics. For example, a planar element 51 as shown in FIG. 9 may replace the planar element 26 shaped as shown in FIGS. 2 and 3. In FIG. 9, the same reference numerals as in FIGS. 2 and 3 denote the same parts. In FIG. 9, one end of the planar element 51 is connected to the ground plane 31 (housing 1), the plate surface is inclined, and the other end is connected to the node 28.

Figure 10:
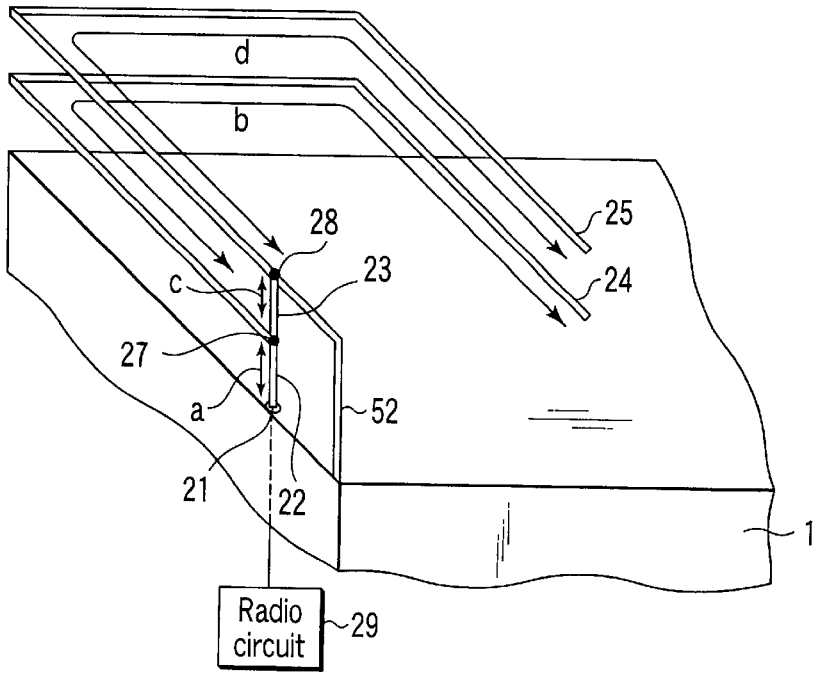
FIG. 10 is a view showing still another arrangement of the antenna shown in FIG. 2 when the planar element 26 is replaced by the wire element 52.

A wire element 52 as shown in FIG. 10 may replace the planar element 26 shaped as shown in FIGS. 2 and 3. In FIG. 10, the same reference numerals as in FIGS. 2 and 3 denote the same parts. In FIG. 10, one end of the wire element 52 is connected to the ground plane 31 (housing 1). The other end not connected to the ground plane 31 is bent into an L shape so as to face the ground plane 31 (housing 1), and is connected to the node 28.

Figure 11:
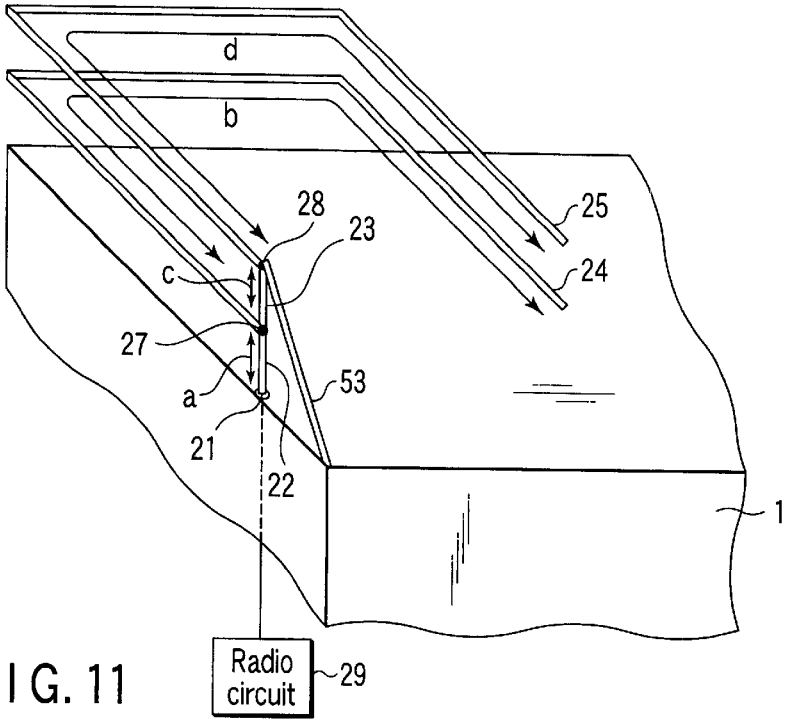
FIG. 11 is a view showing still another arrangement of the antenna shown in FIG. 2 when the planar element 26 is replaced by the wire element 53.

A wire element 53 as shown in FIG. 11 may replace the planar element 26 shaped as shown in FIGS. 2 and 3. In FIG. 11, the same reference numerals as in FIGS. 2 and 3 denote the same parts. In FIG. 11, the wire element 53 is inclined between the ground plane 31 (housing 1) and the node 28. One end of the wire element 53 is connected to the ground plane 31, and the other end is connected to the node 28.

Referring back to FIG. 7, the frequency characteristic of the series resonant antenna having the arrangement shown in FIG. 7 also changes by changing the parameter values e and f which determine the shape of the planar element 26. The frequency characteristics will be explained with reference to FIGS. 8A and 8B.

Figure 8A:
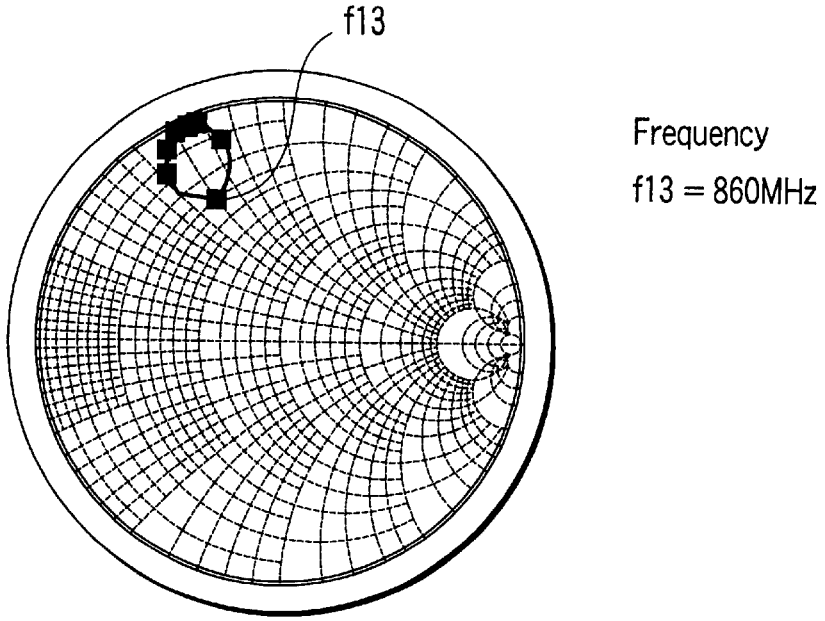
FIG. 8A is a Smith chart showing a change in the impedance of the first series resonant antenna having the arrangement shown in FIG. 7 when a frequency signal is supplied from the feed point 21 shown in FIG. 7 while the frequency is changed.

FIG. 8A is a Smith chart showing a change in the impedance of the first series resonant antenna when a frequency signal is supplied from the feed point 21 in FIG. 7 while the frequency is changed.

Figure 8B:
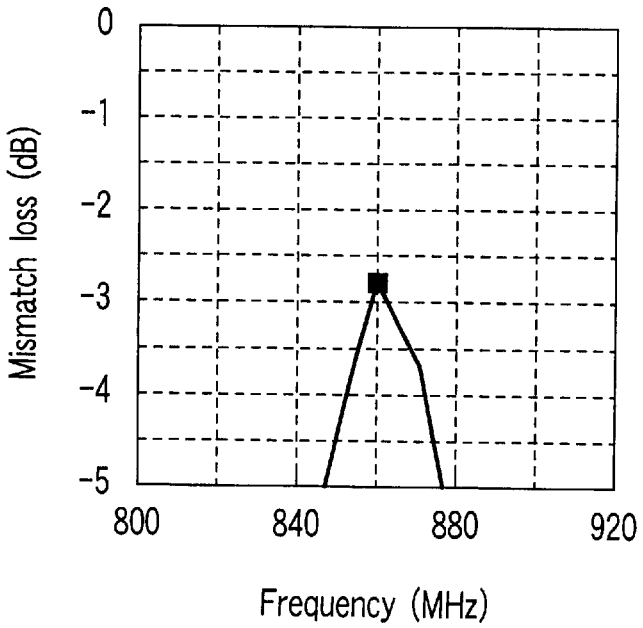
FIG. 8B is a graph showing a change in the mismatch loss of the first series resonant antenna having the arrangement shown in FIG. 7 when the frequency of a frequency signal supplied from the feed point 21 shown in FIG. 7 is changed.

FIG. 8B is a graph showing a change in the mismatch loss of the first series resonant antenna when the frequency of a radio frequency signal supplied from the feed point 21 shown in FIG. 7 is changed.

The radio frequency signal (input radio frequency signal) supplied from the feed point 21 of the antenna 2 gradually increases the frequency from the frequency f11, similar to the parallel resonant antenna. The frequency f13 is 860 MHz (frequency corresponding to f1) and f16 and f17 are loot in FIG. 8A.

As shown in FIG. 7, the series resonant antenna constituted by the wire antenna elements 22, 23, and 25, and the node 28 connected to the ground plane 31 (housing 1) via the planar element 26 or the like exhibits a circular locus of a change in impedance along with a change in the frequency of an input frequency signal.

The parameters e and f are so adjusted as to satisfy two conditions: the circular locus (on the Smith chart) representing a change in the impedance of the series resonant antenna having the arrangement shown in FIG. 7 along with a change in the frequency of the input frequency signal appears at the end of the circular Smith chart, as shown in FIG. 8A, and the radius of the circle of the locus is a fraction of the diameter of the Smith chart (e.g., about ⅙).

By changing the parameters e and f, the circular locus on the Smith chart changes as follows. As the value e decreases with a fixed value f, the circular locus moves to the end on the Smith chart and the radius of the circle drawn by the locus decreases. On the other hand, as the value f increases with a fixed value e, the circular locus moves to the end on the Smith chart and the radius of the circle drawn by the locus decreases.

In the series resonant antenna shown in FIG. 7, a frequency which minimizes the mismatch loss must be almost the resonant frequency f1 (e.g., f1=860 MHz). For this purpose, the length (parameter d) of the wire antenna element 25 is adjusted. As the parameter value d increases, the frequency which minimizes the mismatch loss decreases. The parameter d is adjusted such that the frequency which minimizes the mismatch loss becomes almost 860 MHz.

When e, f, and d become almost 2 mm, 5 mm, and 86 mm, respectively, as a result of adjusting the parameters e and f, the circular locus representing a change in the impedance of the series resonant antenna having the arrangement shown in FIG. 7 along with a change in the frequency of an input frequency signal appears at the end of the Smith chart, as shown in FIG. 8A. The size (radius) of the circle of the locus becomes almost ⅙ the diameter of the Smith chart. The mismatch loss is minimized at 860 MHz corresponding to f1, as shown in FIG. 8B.

In this manner, the parameters a, e, f, and d are determined. In the above example, when the resonant frequencies f1, f2, and f3 are almost 860 MHz, 900 MHz, and 880 MHz, respectively, the parameters a, b, c, d, e, and f of the antenna 2 are determined to 2.5 mm, 80 mm, 5 mm, 86 mm, 2 mm, and 5 mm, respectively. The frequency characteristics of the antenna 2 in this case are shown in FIGS. 12A and 12B.

Figure 12A:
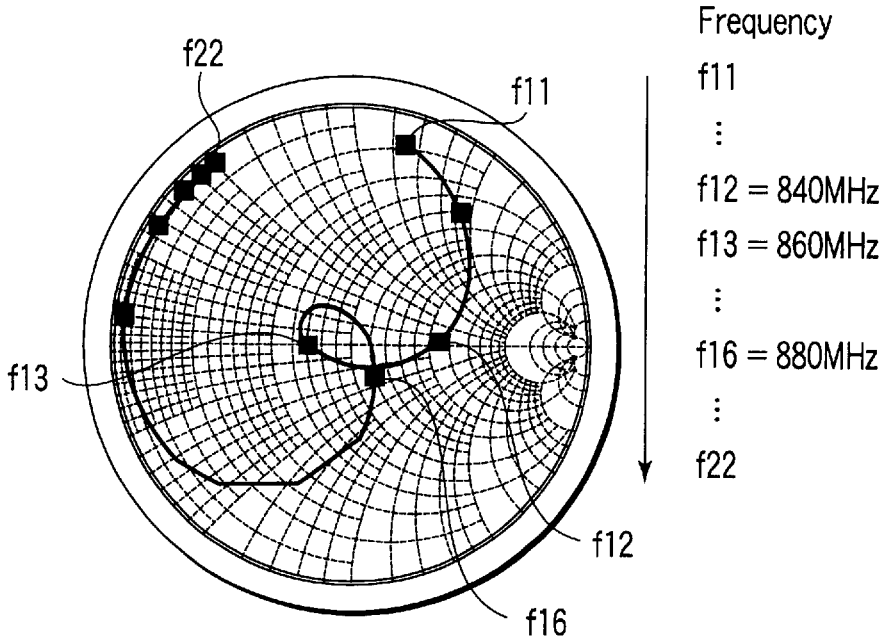
FIG. 12A is a Smith chart showing a change in the impedance of the antenna 2 shown in FIG. 3 when a frequency signal is supplied from the feed point 21 in FIG. 3 while the frequency is changed.

FIG. 12A is a Smith chart showing a change in the impedance of the antenna 2 shown in FIG. 3 when a frequency signal is supplied from the feed point 21 in FIG. 3 while the frequency is changed.

Figure 12B:
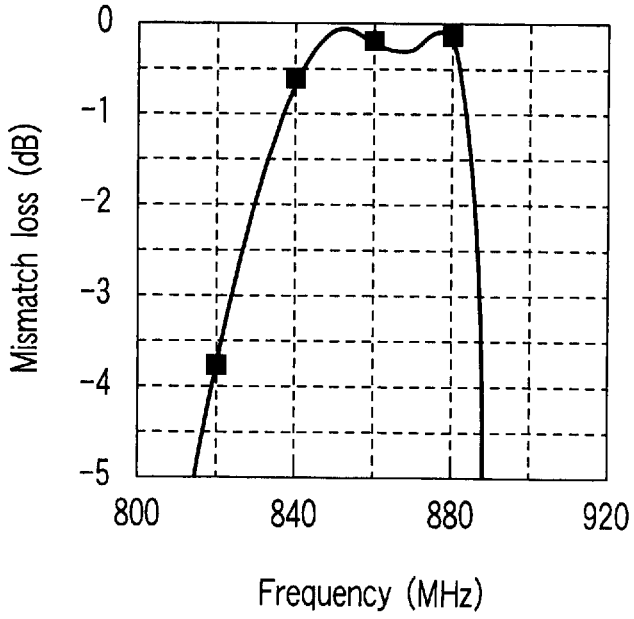
FIG. 12B is a graph showing a change in the mismatch loss of the antenna 2 having the arrangement shown in FIG. 3 when a frequency signal is supplied from the feed point 21 in FIG. 3 while the frequency is changed.

FIG. 12B is a graph showing a change in the mismatch loss of the antenna 2 having the arrangement shown in FIG. 3 when a frequency signal is supplied from the feed point 21 in FIG. 3 while the frequency is changed.

The frequency signal (input frequency signal) supplied from the feed point 21 gradually increases the frequency from the frequency f11. The frequency f12 is 840 MHz; f13, 860 MHz; and f16, 880 MHz.

When the frequency of a frequency signal input to the antenna 2 is almost 840 MHz, 860 MHz, or 880 MHz, the reactance of the antenna 2 having the arrangement shown In FIG. 3 becomes almost "0", as shown in FIG. 12A. When the frequency of the input frequency signal is 840 MHz, 860 MHz, or 880 MHz, the mismatch loss becomes almost "0", as shown in FIG. 12B. As is also apparent from FIG. 12B, the antenna 2 with a transmission/reception bandwidth whose lower and upper limit frequencies are 840 MHz 880 MHz can be obtained.

Figure 13:
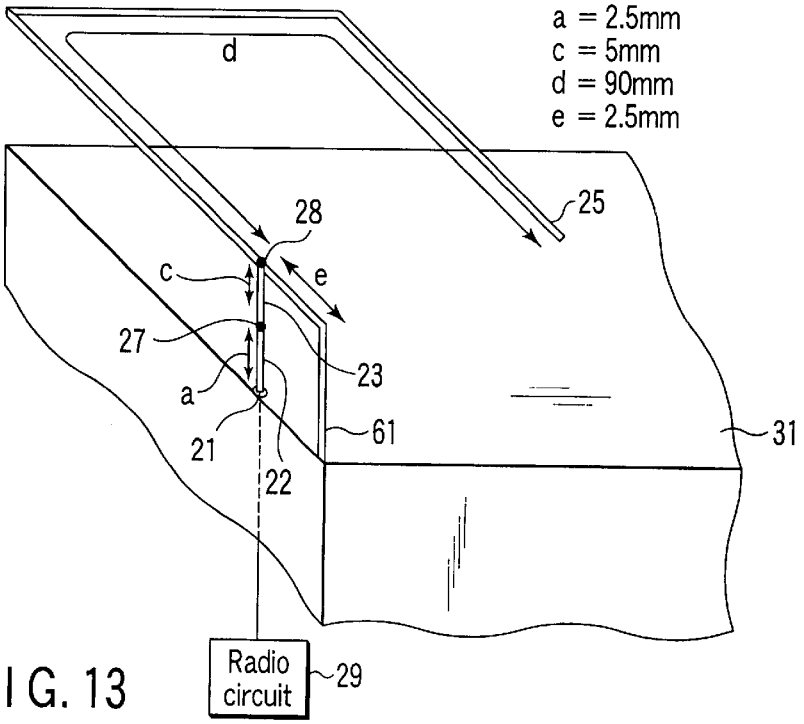
FIG. 13 is a view showing the arrangement of an inverted-F antenna constituted by removing the third wire antenna element 24 from the antenna 2 shown in FIG. 3 and replacing the planar element 26 with the wire element 61.

FIG. 13 is a view showing the arrangement of an inverted-F antenna constituted by removing the third wire antenna element 24 from the antenna 2 shown in FIG. 3 and replacing the planar element 26 with the wire element 61.

Figure 14A:
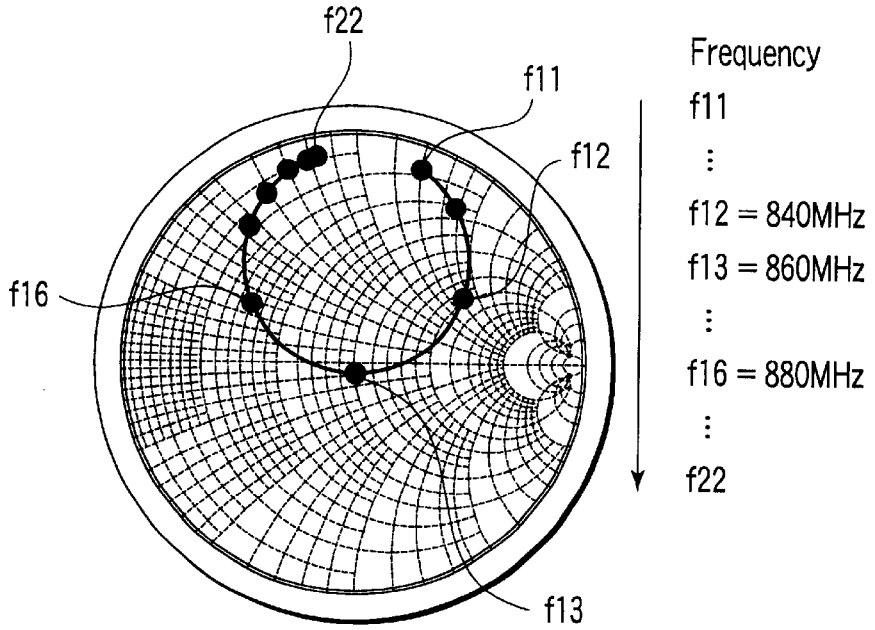
FIG. 14A is a Smith chart showing a change in the impedance of the inverted-F antenna having the arrangement shown in FIG. 13 when a frequency supplied from the feed point 21 in FIG. 13 is changed.
Figure 14B:
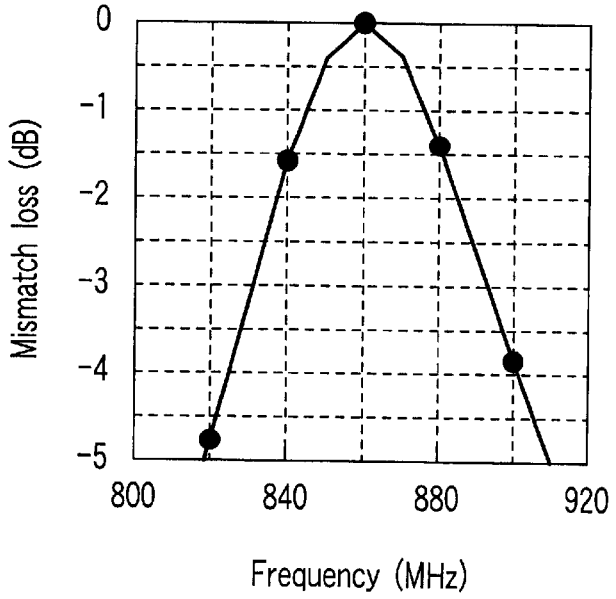
FIG. 14B is a graph showing a change in the mismatch loss of the inverted-F antenna having the arrangement shown in FIG. 13 when a frequency supplied from the feed point 21 in FIG. 13 is changed.

FIGS. 14A and 14B show the frequency characteristics of the inverted-F antenna as shown in FIG. 13 for comparison with the frequency characteristics (see FIGS. 12A and 12B) of the antenna 2 designed in the above way.

In FIG. 13, the same reference numerals as in FIG. 3 denote the same parts. In FIG. 13, one end of the wire element 61 is connected to the ground plane 31 (housing 1). The other end of the wire element 61 that is not connected to the ground plane 31 is bent into an L shape so as to face the ground plane 31 (housing 1), and is connected to the node 28.

In the inverted-F antenna shown in FIG. 13, the lengths of respective wire antenna elements (the length a of the wire antenna element 22, the length c of the wire antenna element 23, the length d of the wire antenna element 25, and the length e of a portion of the wire element 61 that faces the ground plane 31) are a=2.5 mm, c=5 mm, d=90 mm, and e=2.5 mm, respectively.

The inverted-F antenna element is constituted by eliminating the third wire antenna element 24 from the antenna 2 shown in FIG. 3. For the parameter b=0, the remaining parameters can be determined in accordance with inequality (4), similar to the antenna 2 shown in FIG. 3.

FIG. 14A is a Smith chart showing a change in the impedance of the inverted-F antenna having the arrangement shown in FIG. 13 when a frequency supplied from the feed point 21 shown in FIG. 13 is changed.

FIG. 14B is a graph showing a change in the mismatch loss of the inverted-F antenna having the arrangement shown in FIG. 13 when a frequency supplied from the feed point 21 shown in FIG. 13 is changed.

When the frequency of an input frequency signal is almost f13=860 MHz, the reactance of the inverted-F antenna shown in FIG. 13 becomes "0", as shown in FIG. 14A. The mismatch loss also becomes almost "0", as shown in FIG. 14B.

A comparison in frequency characteristic between the inverted-F antenna shown in FIG. 14B and the antenna 2 shown in FIG. 12B at a mismatch loss of −0.5 [dB] reveals that the antenna 2 is as great as two times in bandwidth.

In the above description, the antenna 2 is mounted on the ground plane 31. The antenna 2 can also be mounted on a circuit board or the like, other than the ground plane 31.

In this case, an end of the planar element 26 or 51 or wire element 52 or 53 that is not connected to the node between the second and fourth wire antenna elements 23 and 25 may be grounded (connected to ground (GND)).

In this case, a part can also be mounted at a portion surrounded by the wire antenna elements 24 and 25 on the circuit board. Hence, the part mounting area can be widened in comparison with an antenna (see FIG. 1) using a conventional planar antenna element.

Figure 15:
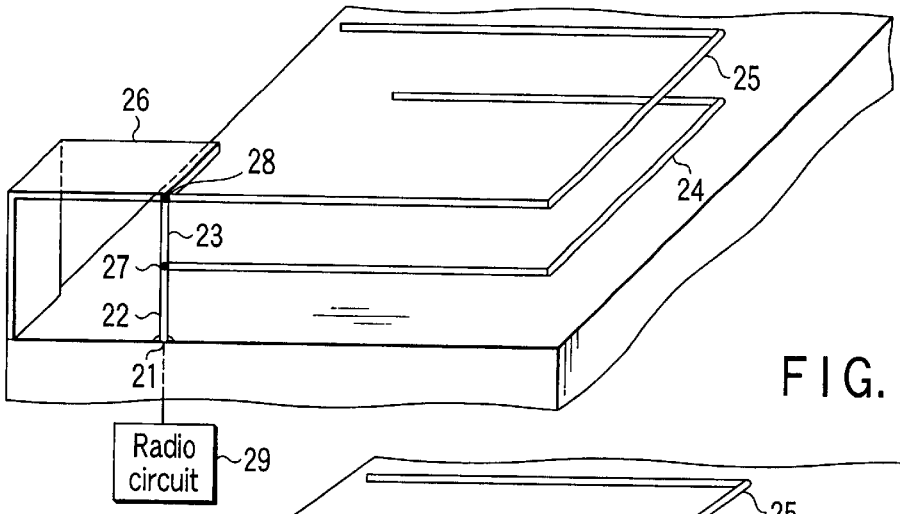
FIG. 15 is a view schematically showing the shapes of wire antenna elements of antenna 2 shown in FIG. 2.
Figure 16:
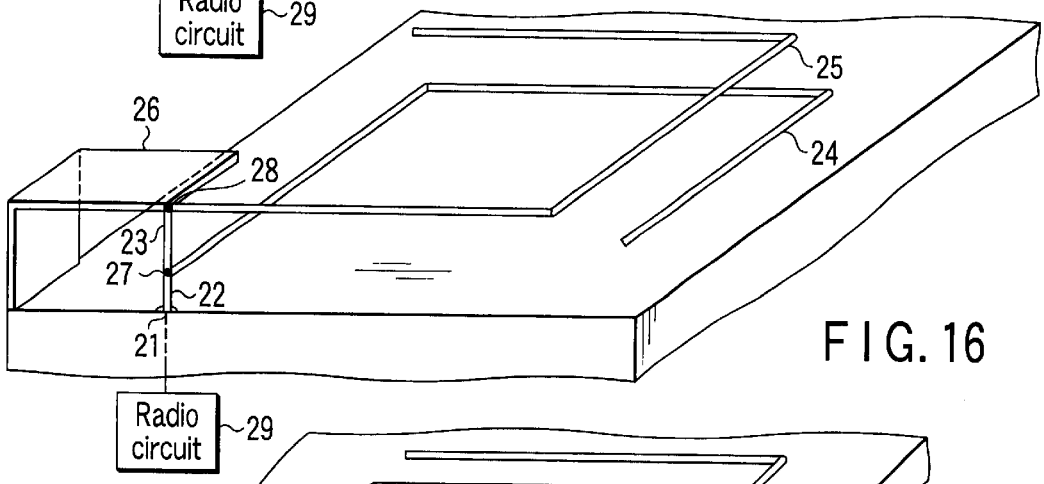
FIG. 16 is a view schematically showing the attaching end of the wire antenna element 24 shown in FIG. 15 is rotated by 90°, and the wire antenna element 24 is reversed. Then, the wire antenna element 24 is aligned with the upper wire antenna element 25 and arranged parallel to it.
Figure 17:
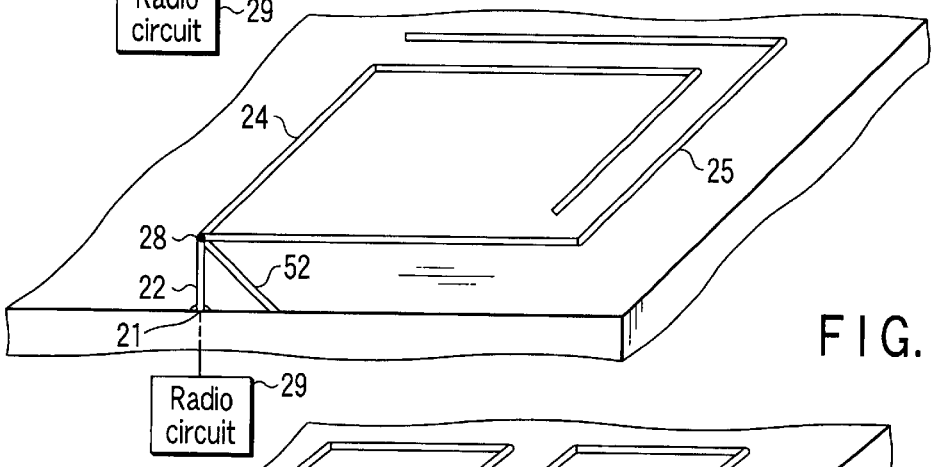
FIG. 17 is a view schematically showing the shapes of the wire antenna elements 24 and 25 applicable to the antenna of the present invention and their layout when the length of the second wire antenna element 23 which constitutes the antenna 2 of the first embodiment is "0"
Figure 18:
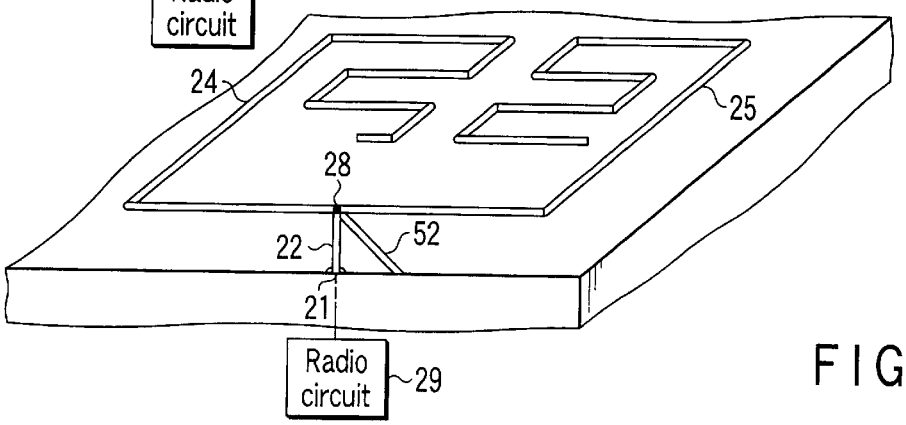
FIG. 18 is a view schematically showing the shapes of the wire antenna elements 24 and 25 applicable to the antenna of the present invention and their layout when the length of the second wire antenna element 23 which constitutes the antenna 2 of the first embodiment is "0"

The shapes of the wire antenna elements 24 and 25 which constitute the antenna 2 will be explained. FIG. 15 shows the shapes of the wire antenna elements 24 and 25 of the antenna 2. FIGS. 16 to 18 show variations of the shapes of the wire antenna elements 24 and 25 applicable to the antenna 2 and variations of their positional relationship.

Note that only the shapes of the wire antenna elements 24 and 25 and their positional relationship are illustrated in FIGS. 15 to 18.

The shapes of the wire antenna elements 24 and 25 and their positional relationship may be changed from those shown in FIGS. 15 to 18. However, the wire antenna elements 24 and 25 must be shaped not to obstruct mounting of other parts on the ground plane 31 when the antenna 2 is mounted on the ground plane 31.

In FIG. 15, the wire antenna elements 24 and 25 shown in FIGS. 2 and 3 are respectively bent into a U shape and arranged parallel to each other at a predetermined interval.

In FIG. 16, the attaching end of the wire antenna element 24 shown in FIG. 15 is rotated by 90°, and the wire antenna element 24 is reversed. Then, the wire antenna element 24 is aligned with the upper wire antenna element 25 and arranged parallel to it.

This arrangement of the wire antenna elements 24 and 25 can change the resonant frequency f3 of parallel resonance and increase the flexibility of the antenna design. This is because a coil is formed depending on the positional relationship between the wire antenna elements 24 and 25, an inductance is generated n the wire antenna elements in parallel resonance, and the electrical length of the antenna elements becomes long. This change in electrical length does not occur in series resonance. This is because a current flows through only the wire antenna element 24 or 25 in series resonance, the figure of current distribution is not looped, and no inductance occurs. The frequency characteristic of the antenna 2 can be adjusted by changing only the parallel resonance antenna without changing the two series resonance antenna. This facilitates the antenna design.

In the antenna 2 shown in FIGS. 15 and 16, the other end of the planar element 26 shown in FIG. 3, that of the planar element 51 shown in FIG. 9, that of the wire element 52 shown in FIG. 10, or that of the wire element 53 shown in FIG. 11 is connected to the node 28 between the wire antenna elements 25 and 23.

FIGS. 17 and 18 are views showing the shapes of the wire antenna elements 24 and 25 applicable to the antenna of the present invention and their layout when the length of the second wire antenna element 23 which constitutes the antenna 2 of the first embodiment is "0".

In FIG. 17, the length of the wire antenna element 23 shown in FIG. 16 is set to "0". The U-shaped wire antenna element 24 is laid out on the same plane inside the U-shaped wire antenna element 25. Also in this case, the lengths of the wire antenna elements 24 and 25 are designed to predetermined values. Similar to the case shown in FIG. 16, the wire antenna elements 24 and 25 are laid out in a coil shape. This layout enables changing the resonant frequency in parallel resonance.

In FIG. 18, the wire antenna elements 24 and 25 shown in FIGS. 2 and 3 are respectively bent into a U shape. The free ends of the wire antenna elements 24 and 25 are respectively bent into a meander shape. The meander-shaped portions of the two wire antenna elements 24 and 25 are laid out to face each other on the same plane.

The case of FIG. 18 eliminates any coil characteristic, unlike the cases of FIGS. 16 and 17. In the cases of FIGS. 16 and 17, the inductance value may increase excessively, and only the resonant frequency f3 may decrease and greatly deviate from the resonant frequency f1 (the resonant frequency f3 does not meet the condition of inequality (2)). Under this situation (particularly in order to decrease the inductance of the wire antenna element), the arrangement shown in FIG. 18 is preferably applied.

In FIGS. 17 and 18, the node 28 of the wire antenna elements 22, 24, and 25 are connected to the other end of the planar element 26 shown in FIG. 3, that of the planar element 51 shown in FIG. 9, that of the wire element 52 shown in FIG. 10, or that of the wire element 53 shown in FIG. 11.

The shapes of the wire antenna elements 24 and 25 and their positional relationship are not limited to those shown in FIGS. 15 to 18, and can be variously modified without departing from the spirit and scope of the present invention.

Even with the shapes and layouts of the wire antenna elements 24 and 25 as shown in FIGS. 16 to 18, the antenna 2 can be mounted on a circuit board or the like in the above-mentioned way.

As described above, the first embodiment can simplify the design (easily determine the parameters a to f) and widen the part mounting area, compared to a conventional planar antenna element.

(Second Embodiment)

An antenna formed from a ribbon-like antenna element with the same antenna principle according to the present invention described in the first embodiment will be explained as the second embodiment.

In general, an antenna uses a ribbon-like antenna element in order to ensure the mechanical strength and reduce the cost. The antenna of the present invention can also adopt a ribbon-like antenna element.

Figure 19:
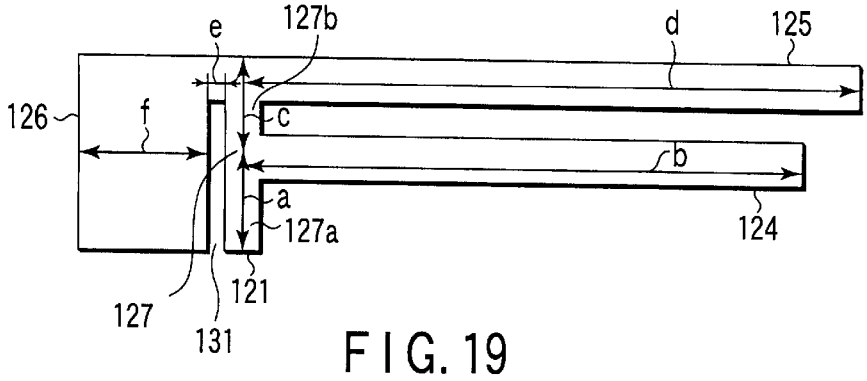
FIG. 19 is a view showing an arrangement of an antenna according to a second embodiment of the present invention.

FIG. 19 shows the arrangement of an antenna according to the second embodiment of the present invention. FIG. 19 also shows the parameters a to f of respective antenna elements in an antenna 2 when each antenna element of the antenna is a ribbon-like antenna element.

As shown in FIG. 19, linear antenna elements used for this antenna are ribbon-like antenna elements in the second embodiment, whereas these linear antenna elements are wire antenna elements in the antenna 2 according to the first embodiment. The ribbon antenna elements have widths, unlike the wire antenna elements described in the first embodiment. The lengths of the center lines of the respective ribbon antenna elements can be set as the parameters a to f as long as the width of each ribbon antenna element is several times, e.g., four times or less the radius of each wire antenna element described in the first embodiment. That is, calculation of the parameters of the antenna according to the second embodiment can directly use the conditional expressions of the parameters of the antenna according to the first embodiment given by inequalities (1) to (4). The antenna shown in FIG. 19 is constituted by forming one slit 131 at a portion corresponding to the vertical line of the F shape of an F-shaped plate prepared by punching the plate into an F shape.

Of ribbon antenna elements 124 and 125 corresponding to two upper and lower horizontal lines of the F shape, the ribbon antenna element 125 corresponding to the upper horizontal line corresponds to the fourth wire antenna element 25 in FIGS. 2 and 3. The ribbon antenna element 124 corresponding to the lower horizontal line corresponds to the third wire antenna element 24 in FIGS. 2 and 3. A ribbon antenna element 127 in the right region divided by the slit 131 at the portion corresponding to the vertical line of the F shape corresponds to the wire antenna elements 22 and 23 in FIGS. 2 and 3. A ribbon element 126 in the left region corresponds to the planar element 26 in FIGS. 2 and 3. A feed point 121 is set at the lower end of the ribbon antenna element 127. The lower end of the ribbon element 126 stands on a ground plane or is grounded.

The length of the centerline of the ribbon antenna element 125 almost corresponds to the parameter value d; and that of the centerline of the ribbon antenna element 124, to the parameter value b. The width of the slit 131 almost corresponds to the parameter value e; and that of the ribbon element 126, to the parameter value f. The length from the lower end of the centerline of the ribbon antenna element 127 to the centerline of the ribbon antenna element 124 almost corresponds to the parameter value a; and the length of the centerline of the ribbon antenna element 127 from the centerline of the ribbon antenna element 124 to the upper end of the ribbon antenna element 127, to the parameter value c.

A portion of the ribbon antenna element 127 from its lower end to the centerline of the ribbon antenna element 124 will be called a ribbon antenna element 127*a*. A portion of the ribbon antenna element 127 from the centerline of the ribbon antenna element 124 to the upper end of the ribbon antenna element 127 will be called a ribbon antenna element 127*b*.

The method of determining the parameters a to f in the arrangement shown in FIG. 19 is also the same as that described in the first embodiment.

More specifically, similar to the first embodiment, the antenna shown in FIG. 19 is an antenna apparatus made up of a first ribbon antenna element 127*a*, a second ribbon antenna element 127*b*, a third ribbon antenna element 124, a fourth ribbon antenna element 125, and a ribbon element 126 which has a lower end grounded or stands on the ground plane. The first ribbon antenna element 127*a* has one end connected to the feed point 121, and is arranged almost perpendicularly to the mounting surface (or ground plane) of the antenna. The third ribbon antenna element 124 has one end connected to the other end of the first ribbon antenna element 127*a*, and is arranged almost parallel to the mounting surface (or ground plane). The second ribbon antenna element 127*b* has one end connected to the node between the first and third ribbon antenna elements 127*a* and 124, and is arranged parallel to the first ribbon antenna element 127*a*. The fourth ribbon antenna element 125 has one end connected to the other end of the second ribbon antenna element 127*b*, and is arranged almost parallel to the third ribbon antenna element 124. The free end of the ribbon element 126 is connected to the node between the second and fourth ribbon antenna elements 127*b* and 125. The first, second, third, and fourth ribbon antenna elements 127*a*, 127*b*, 124, and 125 and ribbon antenna element 126 are arranged on the same plane.

The parameter values a to f are determined as follows. The sum of the lengths of the first, second, and fourth ribbon antenna elements 127*a*, 127*b*, 124, and 125 is ¼ the wavelength (λ1) corresponding to a series-resonance frequency (f1) of the first, second, and fourth ribbon antenna elements 127*a*, 127*b*, 124, and 125. The sum of the lengths of the second, third, and fourth ribbon antenna elements 127*b*, 124, and 125 is ½ the wavelength (λ3) corresponding to a parallel-resonance frequency (f3) of the second, third, and fourth ribbon antenna elements 127*b*, 124, and 125. The sum of the lengths of the first and third ribbon antenna elements 127*a* and 124 is ¼ the wavelength (λ2) corresponding to a series-resonance frequency (f2) of the first and third ribbon antenna elements 127*a* and 124. The resonance frequency f3 is higher than the resonance frequency f1 and lower than the resonance frequency f2.

Similar to the antenna described in the first embodiment, the antenna shown in FIG. 19 can also be mounted on a circuit board. In this case, the lower end of the ribbon element 126 is grounded.

When the antenna is formed from ribbon-like antenna elements, as shown in FIG. 19, the mechanical strength can be ensured and the antenna can also be utilized as an onboard antenna.

As described above, the second embodiment can simplify the design (easily determine the parameters a to f) and widen the part mounting area, compared to a conventional planar antenna element. In addition, this embodiment can ensure mechanical strength and reduce the cost.

The antennas described in the first and second embodiments are not limited to any specific mounting surface as far as the feed point is connected to one end of the first wire antenna element 22 or the lower end of the ribbon antenna element 127, and the free end of the planar element 26 or 51 or wire element 52 or 53 or the lower end of the grounded wire element 126 is grounded.

A planar element identical to the planar element 51 shown in FIG. 9 may replace the ribbon element 126 shown in FIG. 19.

A planar element identical to the wire element 52 shown in FIG. 10 may replace the ribbon element 126 shown in FIG. 19.

A planar element identical to the wire element 53 shown in FIG. 11 may replace the ribbon element 126 shown in FIG. 19.

The antenna shaped as shown in FIG. 19 may be changed into an inverted-F antenna as shown in FIG. 13 by removing third ribbon antenna elements 124.

The third and fourth ribbon antenna elements 124 and 125 as shown in FIG. 19 have a straight shape. However, the shapes of the ribbon antenna elements are not limited to the straight shape. For example, as shown in FIG. 15, ribbon antenna elements parallel to each other may be bent into a U shape and arranged parallel to each other at a predetermined interval. Alternatively, as shown in FIG. 16, one of the ribbon antenna elements parallel to each other may be reversed, aligned with the upper ribbon antenna element, and arranged parallel to it. Alternatively, as shown in FIG. 17, ribbon antenna elements parallel to each other may be bent into a U shape and arranged on the same plane. As shown in FIG. 18, it is also possible to bend ribbon antenna elements parallel to each other into a U shape, bend their free ends into a short-wave shape, and arrange the short wave-shaped portions so as to face each other on the same plane.

(Third Embodiment)

The antenna 2 shown in FIG. 3 according to the first embodiment has a transmission/reception bandwidth whose lower and upper limit frequencies are 840 MHz and 880 MHz, as shown in FIG. 12B. However, some of devices which comprise the antenna 2 require a wider transmission/reception bandwidth and must reduce upward directivity of radiation from an antenna element parallel to the ground plane. To satisfy these conditions, the gist of the third embodiment is to widen the frequency band and improve the radiation directivity.

The third embodiment will exemplify an antenna 200 obtained by adding another pair of wire antenna elements parallel to a ground plane that correspond to the third and fourth wire antenna elements 24 and 25 in FIG. 2.

Figure 20:
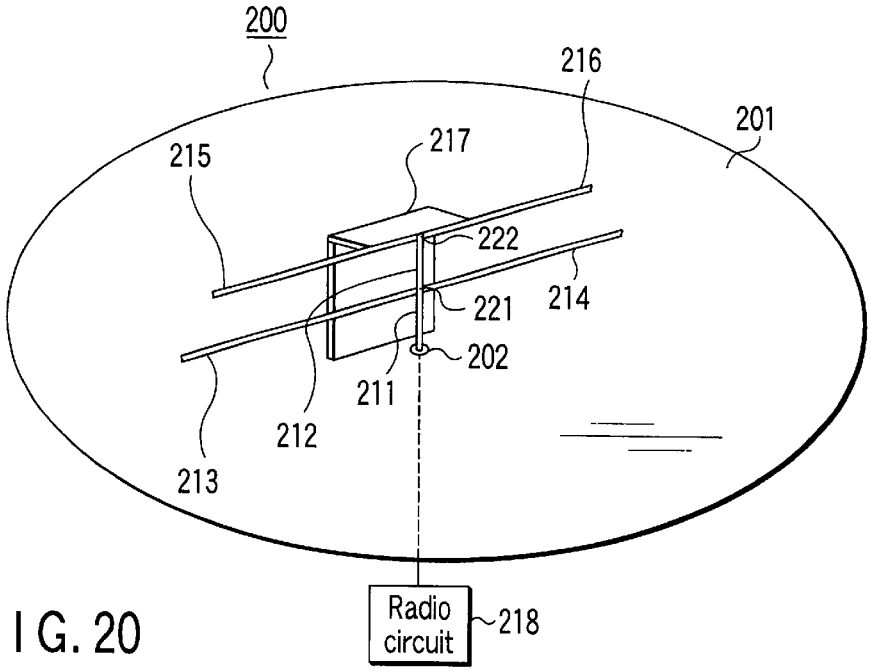
FIG. 20 is a view showing an arrangement of an antenna 200 according to a third embodiment of the present invention.

FIG. 20 shows an arrangement of the antenna 200 according to the third embodiment. The antenna 200 is mounted on a ground conductor (ground plane) 201. Signals are transmitted between, e.g., a wireless device and the antenna 200 via a feed point 202 so set as not to be electrically connected to the ground plane 201. In FIG. 20, the feed point 202 is set at the center of the ground plane 201 for descriptive convenience. Regardless of where the feed point 202 is set on the ground plane 201, the same effects can be obtained by adjustment. The following calculation assumes a ground plane 201 with an infinite size for convenience. Characteristics are slightly influenced by the size of the ground plane 201. However, this influence can be eliminated by adjustment, and the same effects as those of the infinite plate can be attained.

The antenna 200 shown in FIG. 20 is constituted by first, second, third, fourth, fifth, and sixth wire antenna elements 211, 212, 213, 214, 215, and 216, and an L-shaped planar element 217 which stands at one end on the ground plane 201 and bends a free end to face the ground plane 201.

A radio circuit 218 is connected to the feed point 202 and transmits and receives a radio wave via the first, second, third, fourth, fifth, and sixth wire antenna elements 211, 212, 213, 214, 215, and 216.

The first, second, third, fourth, fifth, and sixth wire antenna elements 211, 212, 213, 214, 215, and 216 need not be limited to the wire antenna elements but can take any shape as far as these antenna elements are linear.

In this case, a planar element 217 is not limited to the plate shape and can be formed from a linear antenna element.

As shown in FIG. 20, the first wire antenna element 211 of the antenna 200 has one end connected to the feed point 202, and is arranged almost perpendicularly to the ground plane 201. The third wire antenna element 213 has one end connected to the other end of the first wire antenna element 211, and is arranged almost parallel to the ground plane 201. A node 221 between the other end of the first wire antenna element 211 and one end of the third wire antenna element 213 is connected to one end of the fourth wire antenna element 214, which is arranged almost parallel to the ground plane 201.

The third and fourth wire antenna elements 213 and 214 connected to the node 221 are arranged on a plane almost parallel to the ground plane 201.

The node 221 is further connected to one end of the second wire antenna element 212 whose axis is so arranged as to coincide with the axis of the first wire antenna element 211. The other end of the second wire antenna element 212 is connected to almost the center of the free end of the planar element 217. A node 222 between the other end of the second wire antenna element 212 and the planar element 217 is connected to one end of the fifth wire antenna element 215, which is arranged almost parallel to the ground plane 201. The node 222 is further connected to one end of the sixth wire antenna element 216, which is arranged almost parallel to the ground plane 201.

A division line which halves the angle defined by the third and fourth wire antenna elements 213 and 214, and a division line which halves the angle defined by the fifth and sixth wire antenna elements 215 and 216 are in the same direction.

Figure 21:
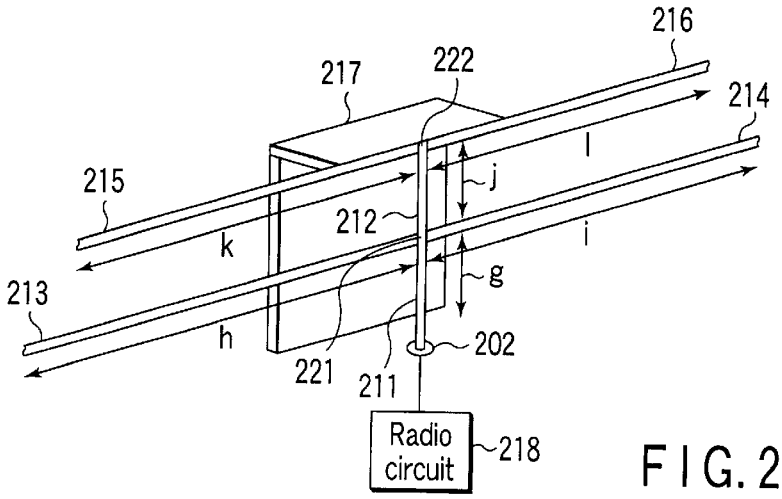
FIG. 21 is a view for explaining in more detail an arrangement in terms of a operation of the antenna 200 shown in FIG. 20.

FIG. 21 is a view for explaining in more detail the arrangement of the antenna 200 in terms of its operation. Portions representing (design) parameters g to l of respective antenna elements are also illustrated in FIG. 21.

The antenna 200 comprises a combination of a first series resonant antenna made up of a feed line formed from the first and second wire antenna elements 211 and 212, the fifth wire antenna element 215, and the planar element 217, a second series resonant antenna made up of the feed line, the sixth wire antenna element 216, and the planar element 217, a first parallel resonant antenna made up of the second, third, and fifth wire antenna elements 212, 213, and 215, and a second parallel resonant antenna made up of the second, fourth, and sixth wire antenna elements 212, 214, and 216.

As shown in FIG. 21, let g be the length of the first wire antenna element 211 which connects the feed point 202 and node 221; h, the length of the third wire antenna element 213 having one end connected to the node 221; i, the length of the fourth wire antenna element 214 having one end connected to the node 221; j, the length of the second wire antenna element 212 which connects the nodes 221 and 222; k, the length of the fifth wire antenna element 215 having one end connected to the node 222; and l, the length of the sixth wire antenna element 216 having one end connected to the node 222.

In this case, λx represents both the resonant wavelengths of the first and second series resonant antennas; and λy, both the resonant wavelengths of the first and second parallel resonant antennas.

Figure 22A:
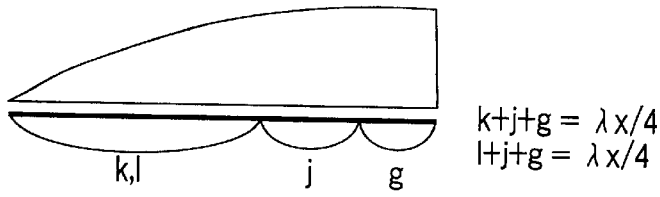
FIG. 22A is a view showing a condition which must be satisfied by first and second series resonant antennas in an antenna 200 shown in FIG. 20.

FIG. 22A is a view showing a condition which must be satisfied by the first and second series resonant antennas in the antenna 200 shown in FIG. 20.

Figure 22B:
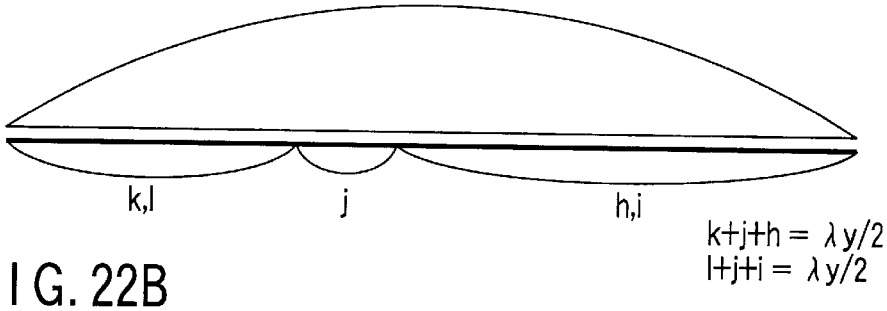
FIG. 22B is a view showing a condition which must be satisfied by first and second parallel resonant antennas in the antenna 200 shown in FIG. 20.

FIG. 22B is a view showing a condition which must be satisfied by the first and second parallel resonant antennas in the antenna 200 shown in FIG. 20.

As shown in FIG. 22A, the sum (k+j+g) of the lengths of the first, second, and fifth wire antenna elements 211, 212, and 215 which constitute the first series resonant antenna is ¼ the wavelength λx corresponding to the resonance frequency of the first series-resonant antenna. Similarly, the sum (l+j+g) of the lengths of the first, second, and sixth wire antenna elements 211, 212, and 216 which constitute the second series resonant antenna is ¼ the wavelength λx corresponding to the resonance frequency of the second series-resonant antenna.

In other words, the sum (k+j+g) of the lengths of the first, second, and fifth wire antenna elements 211, 212, and 215 which constitute the first series resonant antenna, and the sum (l+j+g) of the lengths of the first, second, and sixth wire antenna elements 211, 212, and 216 which constitute the second series resonant antenna are ¼ the wavelength λx corresponding to the resonance frequency of the first and second series-resonant antennas.

As shown in FIG. 22B, the sum (k+j+h) of the lengths of the second, third, and fifth wire antenna elements 212, 213, and 215 which constitute the first parallel resonant antenna is ½ the wavelength λy corresponding to the resonance frequency of the first parallel-resonant antenna. Similarly, the sum (l+j+i) of the lengths of the second, fourth, and sixth wire antenna elements 212, 214, and 216 which constitute the second parallel resonant antenna is ½ the wavelength λy corresponding to the resonance frequency of the second parallel-resonant antenna.

In other words, the sum (k+j+h) of the lengths of the second, third, and fifth wire antenna elements 212, 213, and 215 which constitute the first parallel resonant antenna, and the sum (l+j+i) of the lengths of the second, fourth, and sixth wire antenna elements 212, 214, and 216 which constitute the second parallel resonant antenna are ½ the wavelength λy corresponding to the resonance frequency of the first and second parallel-resonant antennas.

These sums can be given by $$k+j+g=\lambda x/4 \tag{11}$$

$$l+j+g=\lambda x/4 \tag{12}$$

$$k+j+h=\lambda y/2 \tag{13}$$

$$l+j+i=\lambda y/2 \tag{14}$$

Modifying equations (11) to (14) yields $$h=i \tag{15}$$

$$k=l \tag{16}$$

To operate the antenna 200 in a frequency band corresponding to the wavelength λx and a frequency band corresponding to the wavelength λy, the length h of the third wire antenna element 213 and the length i of the fourth wire antenna element 214 must be equal to each other. In addition, the length k of the fifth wire antenna element and the length l of the sixth wire antenna element must be equal to each other.

Figure 23:
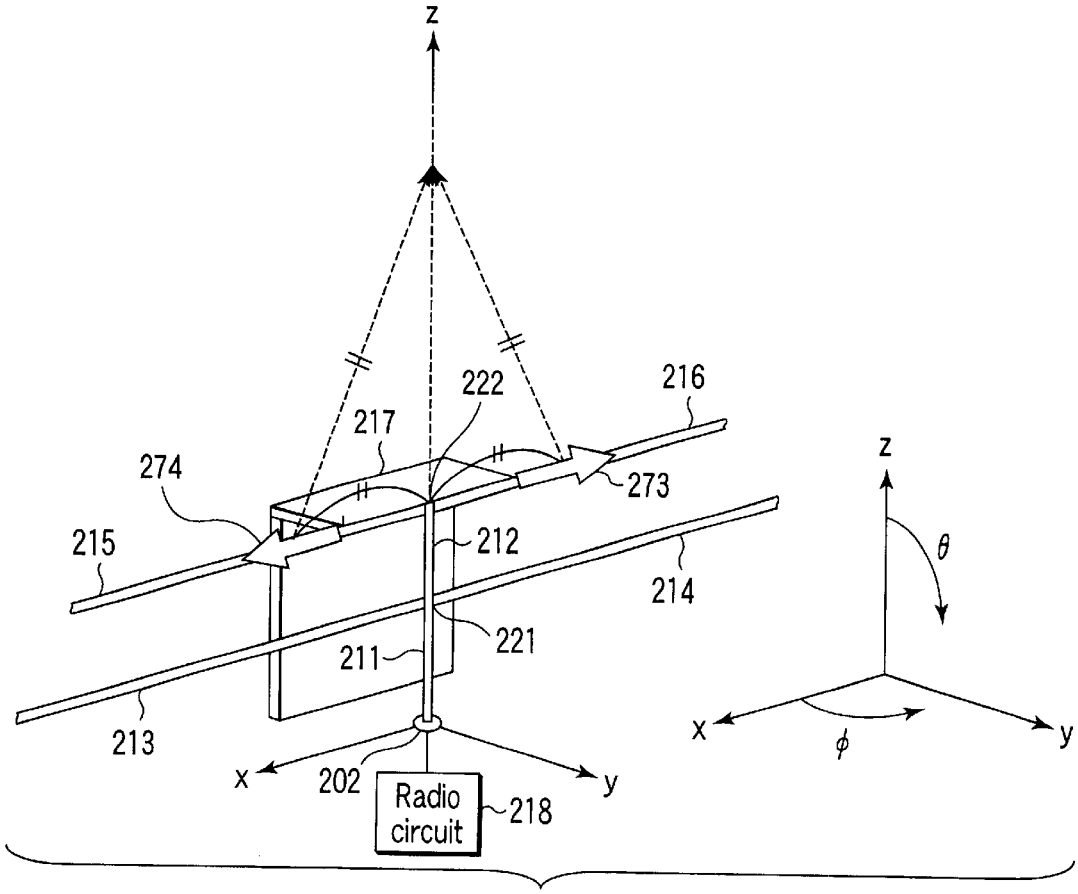
FIG. 23 is a view for explaining features in terms of the operation of the antenna 200 shown in FIG. 20.

FIG. 23 is a view for explaining features in terms of the operation of the antenna 200 shown in FIG. 20.

As shown in FIG. 23, a direction along the connection end between the planar element 217 and the ground plane 201 by using the feed point 202 as an origin is defined as an x-axis. A direction perpendicular to the ground plane 201 is defined as a z-axis. In the antenna 200, the positional relationships between the third and fourth wire antenna elements 213 and 214 and between the fifth and sixth wire antenna elements 215 and 216 are axisymmetrical about a y-z plane (this y-z plane contains a division line which halves the angle defined by the third and fourth wire antenna elements 213 and 214 and the angle defined by the fifth and sixth wire antenna elements 215 and 216) containing the first and second wire antenna elements 211 and 212.

In this case, the angle defined by the third and fourth wire antenna elements 213 and 214 connected to the node 221 and the angle defined by the fifth and sixth wire antenna elements 215 and 216 connected to the node 222 are both 180°. The angles are not limited to this, and may be smaller than 180° as far as the division line which halves the angle defined by the third and fourth wire antenna elements 213 and 214 and the division line which halves the angle defined by the fifth and sixth wire antenna elements 215 and 216 are in the same direction. Even if these angles are different from each other, the following effects can be obtained by adjustment.

The antenna 200 is axisymmetrical about the y-z plane containing the first and second wire antenna elements 211 and 212 (to be simply referred to as a y-z plane hereinafter). Thus, as shown in FIG. 23, currents 273 and 274 equal in magnitude with opposite phases flow at points equidistant from the y-z plane in the third and fourth wire antenna elements 213 and 214 and in the fifth and sixth wire antenna elements 215 and 216. These currents cancel each other in the zenith direction (z-axis) on the y-z plane, reducing undesirable radiation.

Figure 24:
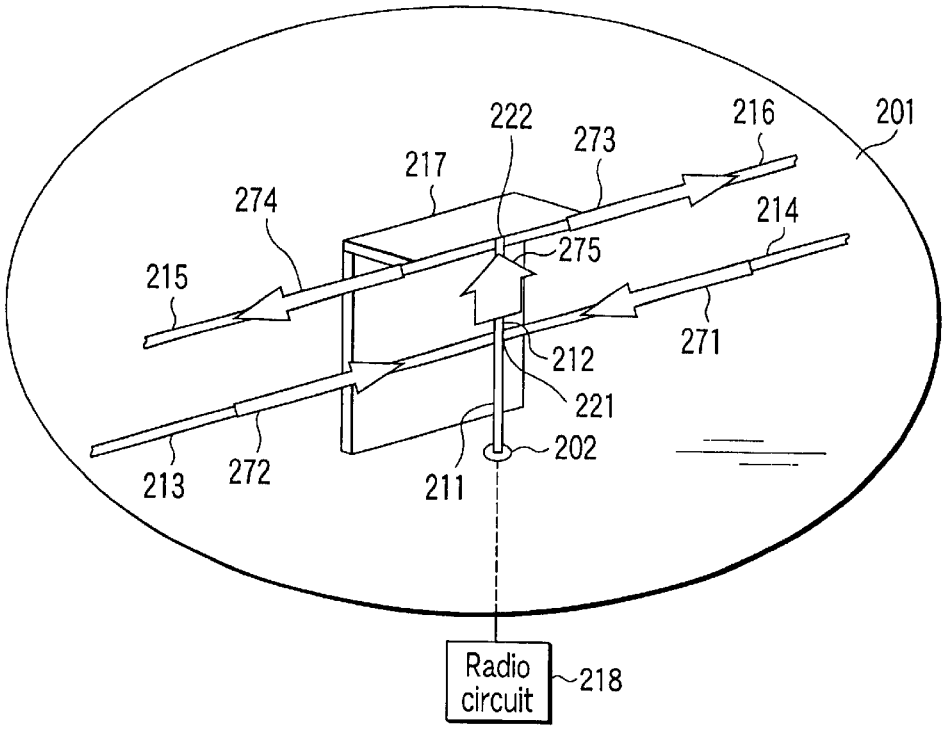
FIG. 24 is a view for explaining features in terms of the operation of the antenna 200 shown in FIG. 20.

FIG. 24 is a view for explaining a current flowing through the antenna 200 shown in FIG. 20.

Wire antenna elements (third, fourth, fifth, and sixth wire antenna elements 213, 214, 215, and 216) parallel to the ground plane 201 extend right and left from the feed line made up of the first and second wire antenna elements 211 and 212. Compared to the antenna shown in FIG. 2 in which wire antenna elements parallel to the ground plane extend in only one direction, currents 271 to 274 flowing through the respective wire antenna elements (third, fourth, fifth, and sixth wire antenna elements 213, 214, 215, and 216) parallel to the ground plane decrease. However, as shown in FIG. 24, a current 275 flowing through the second wire antenna element 212 functioning as a feed line does not change. As a result, the radiation resistance relatively increases to realize a broadband antenna.

The antenna 200 which exhibits a good impedance characteristic at frequencies of 820 MHz and 950 MHz will be examined. In this case, the parameters g to 1 of the antenna 200 can be easily calculated as follows:

Letting λx be the wavelength of 820 MHz, and λy be the wavelength of 950 MHz, $$\lambda x/4=92 \text{ mm} \tag{17}$$

$$\lambda y/2=158 \text{ mm} \tag{18}$$

Assuming that the antenna height (sum of the length g of the first wire antenna element 211 and the length j of the second wire antenna element 212) is 20 mm, from equations (11) and (16)

$$k=l=72 \text{ mm} \tag{19}$$

From equations (11), (13), and (15), $$h-g=i-g=66 \text{ mm} \tag{20}$$

Assuming that the length g of the first wire antenna element is 10 mm, then $$h=i=76 \text{ mm} \tag{21}$$

Note that the length, i.e., parameter h of the third wire antenna element 213 and the length, i.e., parameter i of the fourth wire antenna element 214 are slightly adjusted as follows:

$$h=i=73 \text{ mm} \tag{22}$$

In addition to the parameters g to l, parameters m and n which determine the shape of the planar element 217 are respectively set to 5 mm and 25 mm. The parameter m represents the length of the short side of the horizontal point of the L-shaped planar element 217; and n, the length of the long side of the horizontal point.

The frequency characteristic and radiation pattern will be compared between the antenna 200 with the parameters g to n determined to attain a good impedance characteristic at 820 MHz and 950 MHz, and the antenna shown in FIG. 3 with the parameters a to f similarly determined to attain a good impedance at 820 MHz and 950 MHz.

The antenna having the arrangement shown in FIG. 25 will be explained.

Figure 25:
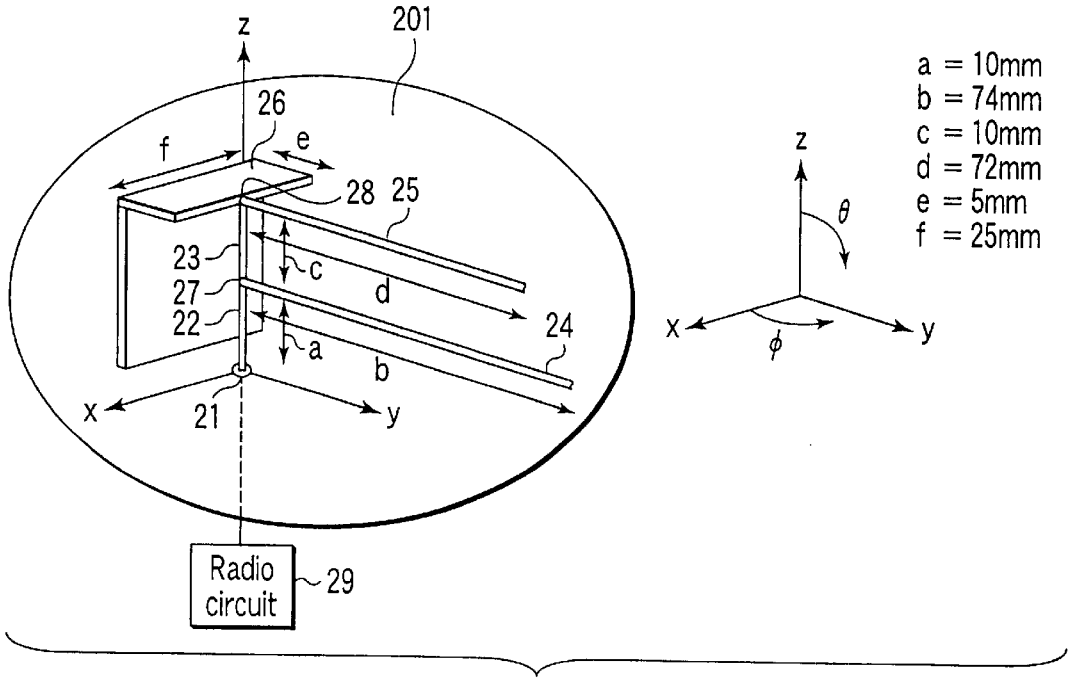
FIG. 25 is a view showing, as a comparison target, an antenna obtained by changing the shape of a planar element 26 of the antenna 2 shown in FIG. 2 and the position of a node 28 between fourth and second wire antenna elements 25 and 23 where the free end of the planar element 26 is connected, and further showing parameter values in comparison.

FIG. 25 is a view schematically showing the antenna in FIG. 3 as a comparison target, and parameter values used for comparison.

In the antenna shown in FIG. 25, the shape of the planar element 26 and the position of the node 28 between the fourth and second wire antenna elements 25 and 23 where the free end of the planar element 26 is connected are different from those of the antenna 2 having the arrangement shown in FIG. 3. Moreover, the wire antenna elements 24 and 25 are respectively connected to the wire antenna elements 22 and 23 without being bent, which is also different from the arrangement of the antenna 2 shown in FIG. 3. However, the difference in arrangement does not influence frequency characteristics.

In FIG. 25, the same reference numerals as in FIGS. 2 and 3 denote the same antenna elements. Portions representing the parameters a to f of the antenna elements shown in FIG. 3 are also illustrated. When the parameters a to f are a=10 mm, b=74 mm, c=10 mm, d=72 mm, e=5 mm, and f=25 mm, as shown in FIG. 25, the antenna shown in FIG. 25 exhibits frequency characteristics as shown in FIGS. 26 and 27.

Figure 26:
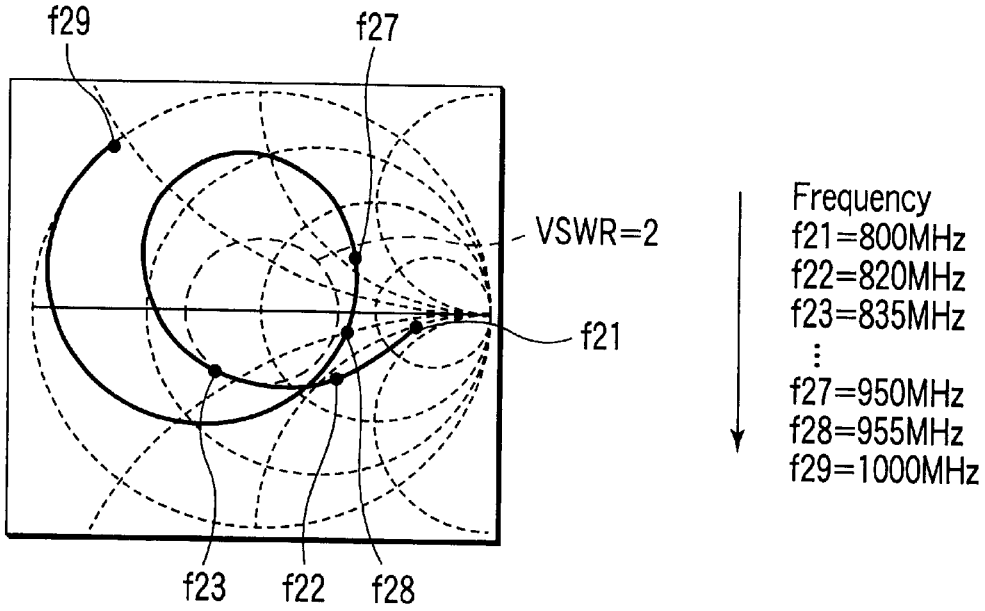
FIG. 26 is a Smith chart showing the frequency characteristic of the impedance of the antenna shown in FIG. 25.

FIG. 26 is a Smith chart showing a change in the impedance of the antenna shown in FIG. 25 when a radio frequency signal is supplied from the feed point 21 in FIG. 25 while the frequency is changed.

Figure 27:
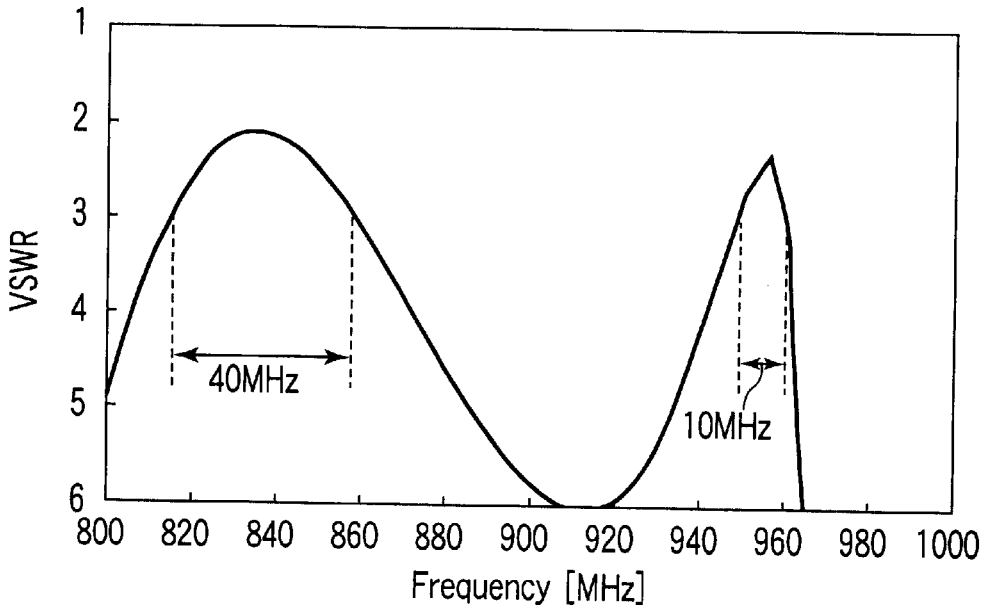
FIG. 27 is a graph showing the frequency characteristic of the voltage standing wave ratio of the antenna shown in FIG. 25.

FIG. 27 is a graph showing a change in the VSWR (Voltage Standing Wave Ratio) of the antenna shown in FIG. 25 when a radio frequency signal is supplied from the feed point 21 in FIG. 25 while the frequency is changed.

The radio frequency signal (input radio frequency signal) supplied from the feed point 21 gradually increases its frequency from a frequency f21 (=800 MHz). A frequency f23 is almost 835 MHz; f28, almost 955 MHz; and f29, 1,000 MHz.

As shown in FIG. 26, the locus of the impedance of the antenna having the arrangement shown in FIG. 25 along with a change in the frequency of the input radio frequency signal changes to draw a loop midway along the locus as the frequency increases. Around the frequencies f23 and f28 of the input radio frequency signal, the locus reaches an impedance at which the VSWR comes closest to "2". The impedance characteristic shown in FIG. 26 also appears in FIG. 27.

As shown in FIG. 27, the locus of the VSWR of the antenna shown in FIG. 25 along with a change in the frequency of the input radio frequency signal exhibits a minimum VSWR of almost "2" at frequencies of almost 835 MHz and 955 MHz.

Figure 28A:
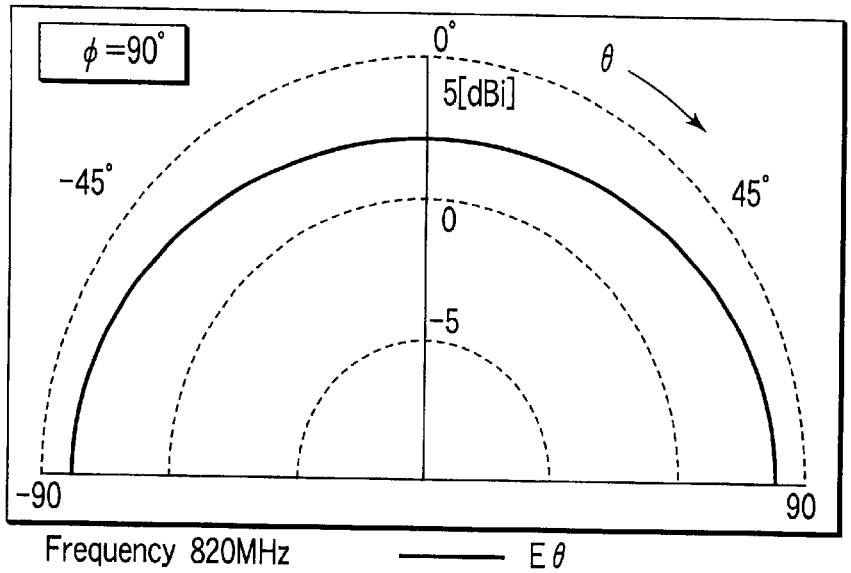
FIG. 28A is a graph showing a radiation pattern when the frequency of a frequency signal supplied from the feed point 21 in FIG. 25 is 820 MHz.

FIG. 28A is a graph showing a radiation pattern when the frequency of a frequency signal supplied from the feed point 21 in FIG. 25 is 820 MHz.

Figure 28B:
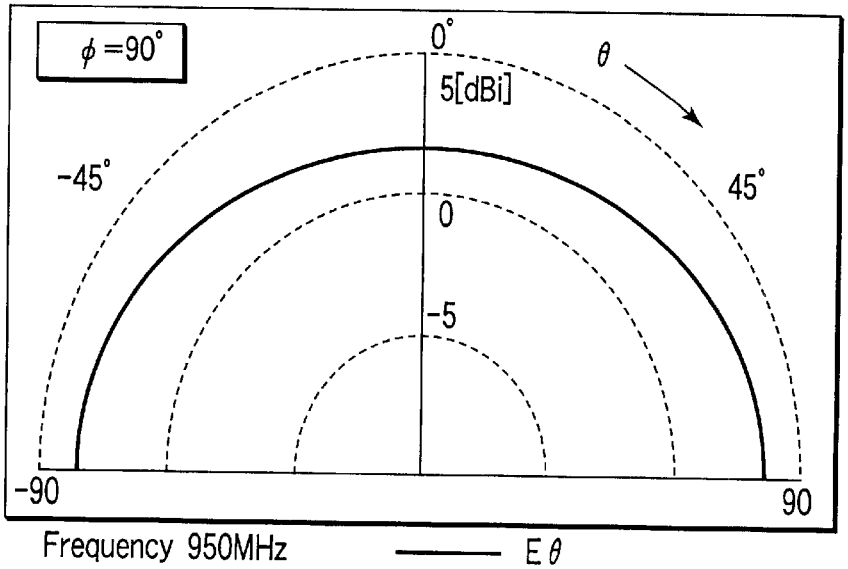
FIG. 28B is a graph showing a radiation pattern when the frequency of a frequency signal supplied from the feed point 21 in FIG. 25 is 950 MHz.

FIG. 28B is a graph showing a radiation pattern when the frequency of a frequency signal supplied from the feed point 21 in FIG. 25 is 950 MHz.

As shown in FIG. 25, a direction along the connection end between the planar element 26 and the ground plane 201 by using the feed point 21 as an origin is defined as an x-axis. A direction perpendicular to the ground plane 201 is defined as a z-axis. In this case, FIGS. 28A and 28B show radiation patterns (upper halves) from θ=−90° to 90° within the y-z plane (ϕ=90°). As shown in FIGS. 28A and 28B, the antenna shown in FIG. 25 is large in radiation along the z-axis (θ=0°).

As is apparent from FIG. 27, the operation band of the antenna is near the frequency 820 MHz and the frequency 950 MHz. The resonance peak is sharp particularly in a frequency band (frequency band of almost 950 MHz) in which the parallel resonant mode has dominance. As is also apparent from FIGS. 28A and 28B, the radiation directivity is large immediately above the antenna, i.e., along the z-axis in FIG. 25.

The antenna 200 shown in FIG. 20 will be explained.

Figure 29:
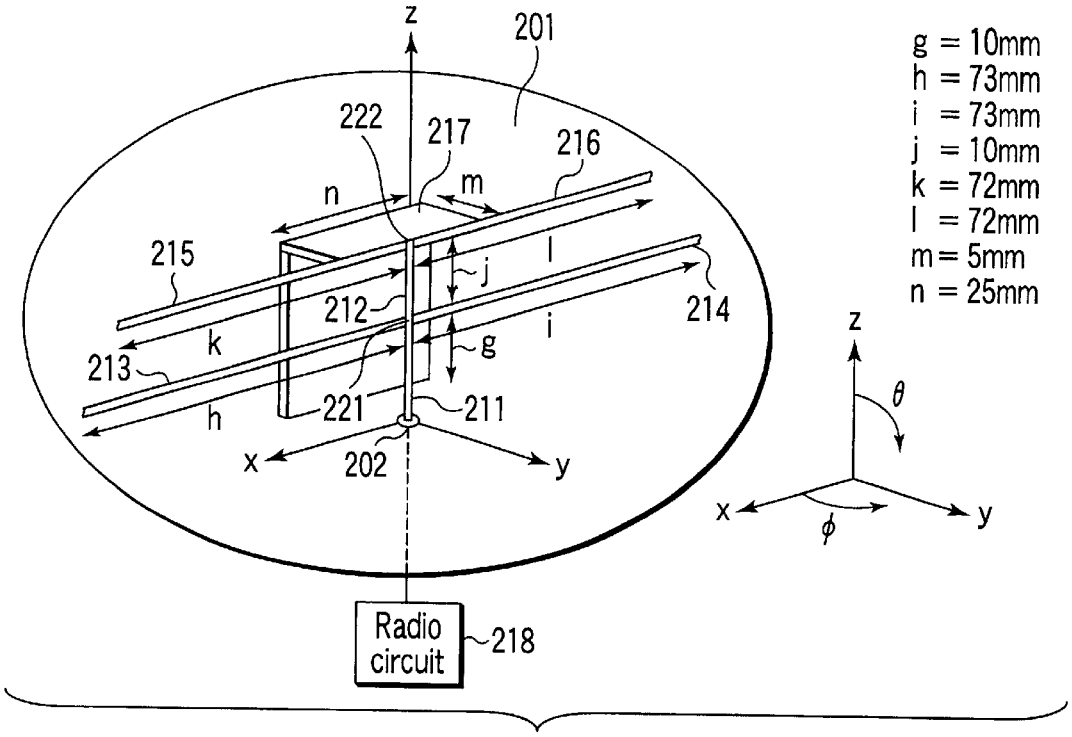
FIG. 29 is a view showing the antenna 200 shown in FIG. 20 together with parameter values g to n of respective antenna elements.

FIG. 29 is a view schematically showing the antenna 200 in FIG. 20, and parameter values used for comparison. In FIG. 29, the same reference numerals as in FIG. 20 denote the same antenna elements. Portions representing the parameters g to l of the antenna elements shown in FIG. 21 and portions representing the parameters m and n which determine the shape of the planar element 217 are also illustrated.

Figure 30:
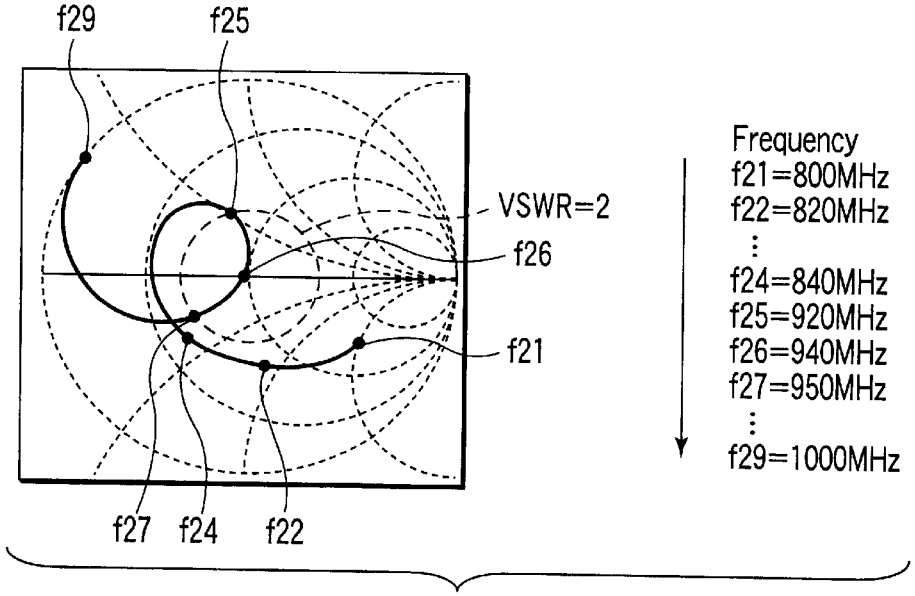
FIG. 30 is a Smith chart showing the frequency characteristic of the impedance of the antenna 200 shown in FIG. 29.
Figure 31:
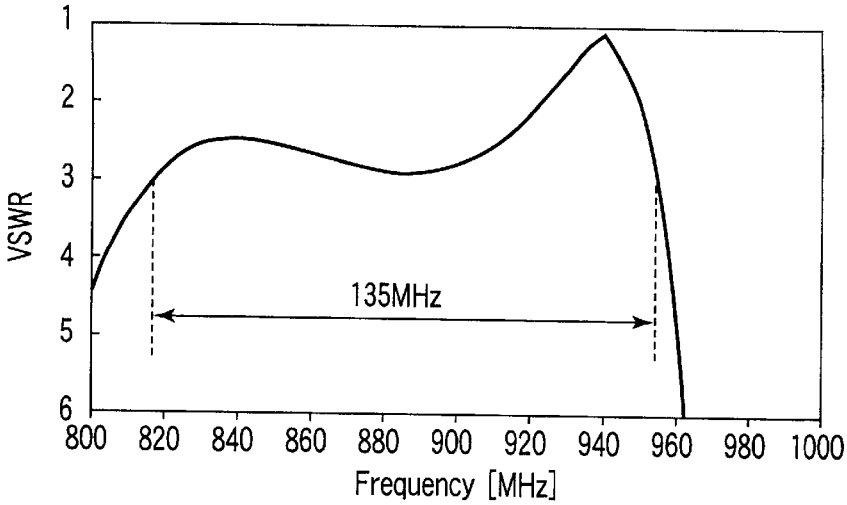
FIG. 31 is a graph showing the frequency characteristic of the voltage standing wave ratio of the antenna 200 shown in FIG. 29.

When the parameters q to n are g=10 mm, h=73 mm, i=73 mm, j=10 mm, k=72 mm, l=72 mm, m=5 mm, and n=25 mm, as shown in FIG. 29, the antenna shown in FIG. 29 exhibits frequency characteristics as shown in FIGS. 30 and 31.

FIG. 30 is a Smith chart showing a change in the impedance of the antenna shown in FIG. 29 when a frequency signal supplied from the feed point 202 shown in FIG. 29 is changed.

FIG. 31 is a graph showing a change in the VSWR (Voltage Standing Wave Ratio) of the antenna shown in FIG. 29 when a frequency signal is supplied from the feed point 202 of FIG. 29 while the frequency is changed.

The radio frequency signal (input radio frequency signal) supplied from the feed point 202 gradually increases its frequency from a frequency f21 (=800 MHz). A frequency f24 is almost 840 MHz; f27, almost 950 MHz; and f29, 1,000 MHz.

As shown in FIG. 30, the locus of the impedance of the antenna having the arrangement shown in FIG. 29 along with a change in the frequency of the input radio frequency signal changes to draw a loop midway along the locus as the frequency increases. Around the frequency f24 of the input radio frequency signal, the locus reaches an impedance at which the VSWR comes closest to "2". As the frequency increases, the locus exhibits an impedance at which the VSWR becomes smaller than "2" between frequencies f25 (almost 920 MHz) and f27 (almost 950 MHz). Especially at a frequency f26 (almost 940 MHz), the locus reaches an impedance at which the VSWR becomes almost "1". The impedance characteristic shown in FIG. 30 also appears in FIG. 31.

As shown in FIG. 31, the locus of the VSWR of the antenna shown in FIG. 29 along with a change in the frequency of the input radio frequency signal exhibits a VSWR of almost "2" at a frequency of almost 840 MHz. As the frequency increases, the VSWR increases. Then, the VSWR decreases again from a frequency of 890 MHz, and minimizes at almost 940 MHz (VSWR comes closest to "1").

In the antenna 200, the parameters g to n are so determined as to attain a good impedance characteristic at 820 MHz and 950 MHz. The VSWR value becomes smaller than "3" in a frequency band of 820 MHz to 955 MHz.

Figure 32A:
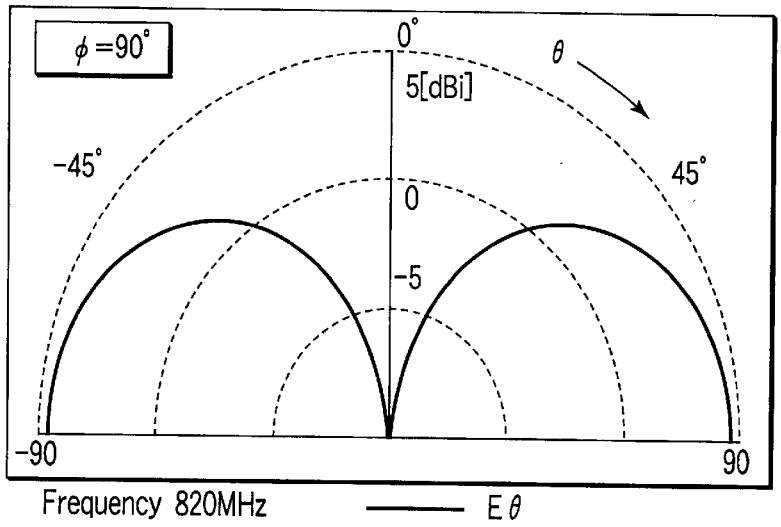
FIG. 32A is a graph showing a radiation pattern when the frequency of a frequency signal supplied from a feed point 202 shown in FIG. 29 is 820 MHz.

FIG. 32A is a graph showing a radiation pattern when the frequency of a frequency signal supplied from the feed point 202 shown in FIG. 29 is 820 MHz.

Figure 32B:
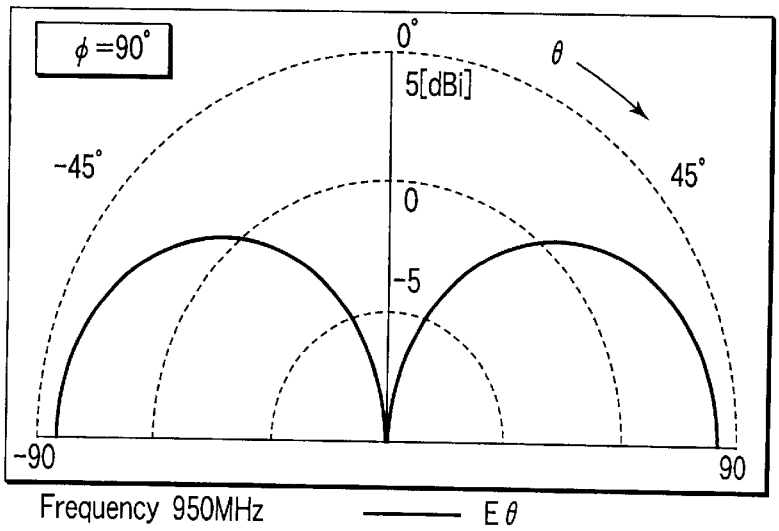
FIG. 32B is a graph showing a radiation pattern when the frequency of a frequency signal supplied from the feed point 202 shown in FIG. 29 is 950 MHz.

FIG. 32B is a graph showing a radiation pattern when the frequency of a frequency signal supplied from the feed point 202 shown in FIG. 29 is 950 MHz.

As shown in FIG. 29, a direction along the connection end between the planar element 217 and the ground plane 201 by using the feed point 202 as an origin is defined as an x-axis. A direction perpendicular to the ground plane 201 is defined as a z-axis. In this case, FIGS. 32A and 32B show radiation patterns (upper halves) from θ=−90° to 90° within the y-z plane (ϕ=90°).

As shown in FIGS. 32A and 32B, the antenna shown in FIG. 29 is small in radiation along the z-axis (θ=0°), and forms a radiation pattern symmetrical along the z-axis.

The frequency characteristic (see FIG. 27) of the VSWR of the antenna shown in FIG. 25 and the frequency characteristic (see FIG. 31) of the VSWR of the antenna 200 shown in FIG. 29 will be compared. The frequency characteristics in FIGS. 27 and 31 are compared at, e.g., a VSWR smaller than "3". In the former case, the frequency bandwidth where the VSWR is smaller than "3" is 50 MHz as the sum of the two frequency bands (see FIG. 27). In the latter case, this frequency bandwidth is one continuous frequency band of 135 MHz (see FIG. 31), which realizes a band at least twice as wide as the former one.

The radiation pattern (see FIGS. 28A and 28B) of the antenna shown in FIG. 25 and the radiation pattern (see FIGS. 32A and 32B) of the antenna 200 shown in FIG. 29 will be compared. The radiation patterns in FIGS. 28A, 28B, 32A, and 32B are compared along the z-axis (θ=0°) within the y-z plane (ϕ=90°). The antenna 200 implements a monopole radiation pattern by suppressing undesirable radiation by 10 dB or more in comparison with the antenna shown in FIG. 25.

As described above, the antenna 200 according to the third embodiment can easily determine parameters and realize a wide transmission/reception frequency band. In addition, this embodiment can implement a horizontal omnidirectivity antenna which reduces undesirable zenithal radiation in the antenna. For example, when the antenna is mounted on a substrate, a wide mounting area for the other parts can be ensured. This antenna is also applicable to a built-in antenna used for a portable information communication terminal such as a cellular phone.

In FIG. 20, the planar element 217 is bent into an L shape such that the other end not connected to the ground plane 201 faces the ground plane 201. The planar element 217 is not limited to this shape as long as one end of the planar element 217 is connected to the ground plane 201 and the other end is connected to the node 222 between the second, fifth, and sixth wire antenna elements 212, 215, and 216.

In short, similar to the description of the first embodiment with reference to FIGS. 9 to 11, the planar element 217 takes any shape as far as the planar element 217 connects the node 222 and ground plane 201 (GND) and has the frequency characteristics as shown in FIGS. 30 and 31. For example, a planar element identical to the planar element 51 shown in FIG. 9 may replace the planar element 217 shaped as shown in FIG. 20. One end of the planar element 51 is connected to the ground plane 201, the plate surface is inclined, and the other end is connected to the node 222.

A planar element identical to the wire element 52 shown in FIG. 10 may replace the planar element 217 shaped as shown in FIG. 20. One end of the wire element 52 is connected to the ground plane 201. The other end not connected to the ground plane 201 is bent into an L shape so as to face the ground plane 201, and is connected to the node 222.

A planar element identical to the wire element 53 shown in FIG. 11 may replace the planar element 217 shaped as shown in FIG. 20. The wire element 53 is inclined between the ground plane 201 and the node 222. One end of the wire element 53 is connected to the ground plane 201, and the other end is connected to the node 222.

The antenna shaped as shown in FIG. 20 may be changed into an inverted-F antenna as shown in FIG. 13 by removing the third and fourth wire antenna elements 213 and 214.

The third, fifth, fourth, and sixth wire antenna elements 213, 215, 214, and 216 as shown in FIG. 20 have a straight shape. However, the shapes of the wire antenna elements are not limited to the straight shape. For example, as shown in FIG. 15, wire antenna elements parallel to each other may be bent into a U shape and arranged parallel to each other at a predetermined interval. Alternatively, as shown in FIG. 16, one of wire antenna elements parallel to each other may be reversed, aligned with the upper wire antenna element, and arranged parallel to it. Alternatively, as shown in FIG. 17, wire antenna elements parallel to each other may be bent into a U shape and arranged on the same plane. As shown in FIG. 18, it is also possible to bend wire antenna elements parallel to each other into a U shape, bend their free ends into a meander shape, and arrange the meander-shaped portions so as to face each other on the same plane.

In the third embodiment, the respective wire antenna elements may be formed from ribbon antenna elements as shown in FIG. 19, as described in the second embodiment. As with the second embodiment, the mechanical strength of the antenna 200 can be ensured, and the cost can be reduced.

The above-described conditions are for generating series resonance and parallel resonance at neighboring frequencies in order to achieve a broadband antenna. The present invention can also be applied to an antenna having two operation bands (band with almost the first operation frequency F1 and band with almost the second operation frequency F2).

Figure 33:
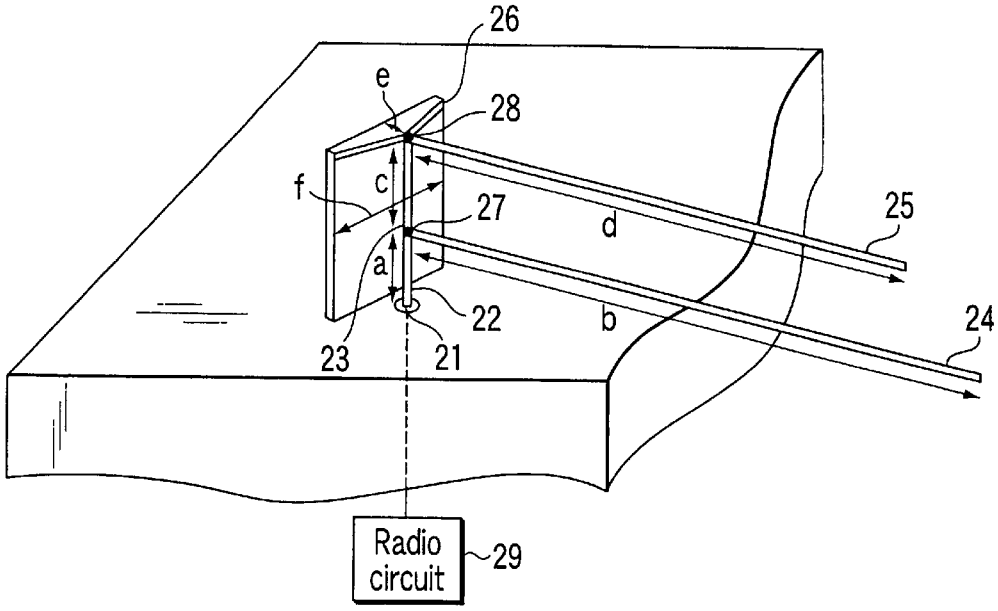
FIG. 33 is a view showing an antenna obtained by changing the shape of the planar element 26 of the antenna 2 shown in FIG. 2, and the position of the node 28 between the fourth and second wire antenna elements 25 and 23 where the free end of the planar element 26 is connected.

FIG. 33 is a view showing an antenna obtained by changing the shape of the planar element 26 of the antenna 2 shown in FIG. 2, and the position of the node 28 between the fourth and second wire antenna elements 25 and 23 where the free end of the planar element 26 is connected.

In FIG. 33, the same reference numerals as in FIGS. 2 and 3 denote the same antenna elements. Portions representing the parameters a to f of the antenna elements shown in FIG. 3 are also illustrated.

As shown in FIG. 33, the shape of the planar element 26 and the position where the node 28 between the fourth and second wire antenna elements 25 and 23 is connected to the free end of the planar element 26 are different from those of the antenna 2 having the arrangement shown in FIG. 3. Moreover, the wire antenna elements 24 and 25 are kept straight and are connected to the wire antenna elements 22 and 23, which is also different from the arrangement of the antenna 2 shown in FIG. 3. However, these differences do not influence the frequency characteristic of the antenna 2. If the parameters a to f of the antenna shown in FIG. 33 are the same as those of the antenna 2 shown in FIG. 3, the frequency characteristics of the antenna shown in FIG. 33 are the same as those of the antenna 2 shown in FIG. 3.

In FIG. 33, the lengths (parameters a, c, and d) of the first, second, and fourth wire antenna elements 22, 23, and 25 are so determined as to generate series resonance at almost the first operation frequency F1=820 MHz. The lengths (parameters b, c, and d) of the third, second, and fourth wire antenna elements 24, 23, and 25 are so determined as to generate parallel resonance at almost the second operation frequency F2=940 MHz.

In this case, the resonant frequency f1 of the first series resonant antenna is assigned to the first operation frequency F1, and the resonant frequency f3 of the parallel resonant antenna is assigned to the second operation frequency F2.

To set the first and second operation frequencies F1 and F2 (which must meet F1 <F2) in the antenna shown in FIG. 33, the parameter conditions of the antenna according to the first embodiment given by inequalities (1) to (4) must be satisfied. These are minimum conditions for determining the parameters.

In the antenna shown in FIGS. 3 and 19, minimum conditions for determining the parameters are the same as those in the antenna shown in FIG. 33.

To set the first and second operation frequencies F1 and F2 (which must meet F1<F2) in the inverted-F antenna shown in FIG. 13, the parameter conditions (for b=0) of the antenna according to the first embodiment given by inequalities (1) to (4) must be satisfied. These are minimum conditions for determining the parameters.

In the antenna 200 shown in FIG. 20, unlike the antennas shown in FIGS. 33, 3, 19, and 13, the first operation frequency Fl is assigned fx having the resonant wavelength λx of the first and second series resonant antennas. The second operation frequency F2 is assigned fy having the resonant wavelength λy of the first and second parallel resonant antennas. In this case, to set the first and second operation frequencies F1 and F2 (which must meet F1<F2) in the antenna 200 shown in FIG. 20, the parameter conditions of the antenna according to the third embodiment given by equations (11) to (16) must be satisfied. These are minimum conditions for determining the parameters. The antenna shown in FIG. 33 is so designed as to operate on a large ground plane.

Figure 34:
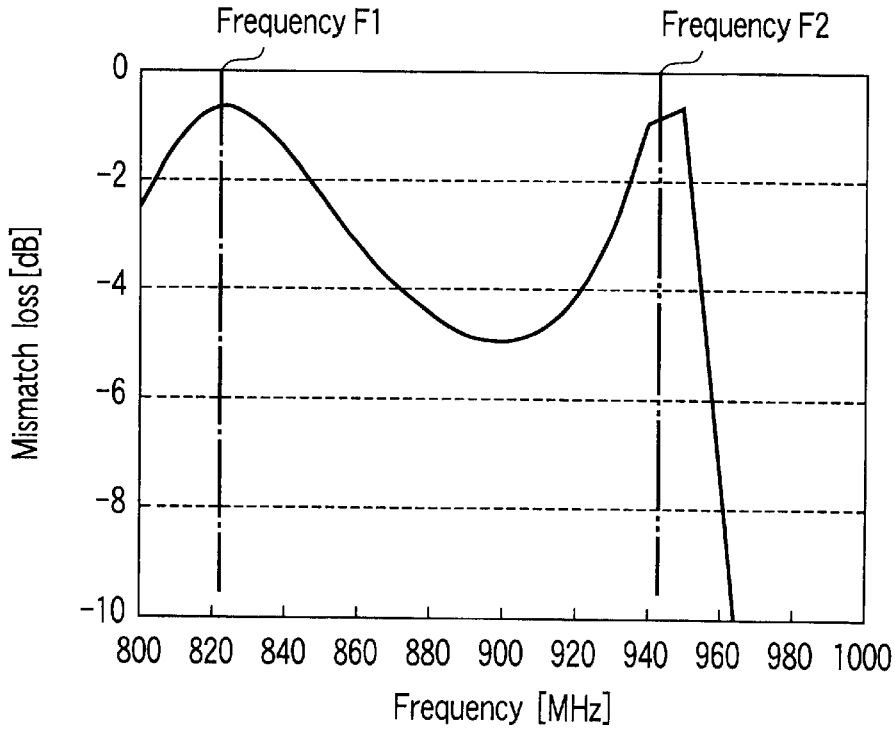
FIG. 34 is a graph showing the frequency characteristic of the antenna having the arrangement shown in FIG. 33.

FIG. 34 is a graph showing the frequency characteristic of the antenna having the arrangement shown in FIG. 33.

For example, when the parameters a to f are a=10 mm, b=78 mm, c=10 mm, d=71 mm, e–2 mm, and f=10 mm, the antenna having the arrangement shown in FIG. 33 exhibits a frequency characteristic as shown in FIG. 34.

In FIG. 34, the mismatch loss decreases at the two operation frequencies F1 =820 MHz and F2 =940 MHz as designed. The antenna operates at these frequencies F1 and F2.

In this manner, parameters can be easily determined even for an antenna having two operation frequencies, and the antenna can be easily designed. As with the first embodiment, when the antenna is mounted on, e.g., a substrate, a wide mounting area for the other parts can be ensured. This antenna can also be applied to a built-in antenna used for a portable information communication terminal such as a cellular phone.

The present invention is not limited to the first to third embodiments, and can be variously modified without departing from the spirit and scope of the invention in practical use. The embodiments include inventions on various stages, and various inventions can be extracted by an appropriate combination of building components disclosed. For example, several building components may be omitted from all those described in the embodiments. Even in this case, as far as (at least one of) the problems described in "BACKGROUND OF THE INVENTION" can be solved, and (at least one of) the effects described in "DETAILED DESCRIPTION OF THE INVENTION" can be obtained, the arrangement from which several building components are removed can be extracted as an invention.

Additional advantages and modifications will readily occur to those skilled in the art. Therefore, the present invention in its broader aspects is not limited to the specific details, and representative device, and illustrated examples shown and described herein. Accordingly, various modifications may be made without departing from the spirit or scope of the general inventive concept as defined by the appended claims and their equivalents.

What is claimed is:

1. An antenna apparatus comprising:

a feed point;

a first linear antenna element which has one end connected to the feed point;

a second linear antenna element which has one end connected to the other end of the first linear antenna element;

a third linear antenna element which has one end connected to the other end of the first linear antenna element;

a fourth linear antenna element which has one end connected to the other end of the second linear antenna element; and a connection element which connects the other end of the second linear antenna element and a ground terminal, wherein a sum of lengths of the first, second, and fourth linear antenna elements is ¼ a wavelength corresponding to a series-resonance frequency of the first, second, and fourth linear antenna elements, a sum of lengths of the second, third, and fourth linear antenna elements is ½ a wavelength corresponding to a parallel-resonance frequency of the second, third, and fourth linear antenna elements, a sum of lengths of the first and third linear antenna elements is ¼ a wavelength corresponding to a series-resonance frequency of the first and third linear antenna elements, and the parallel-resonance frequency is higher than a frequency of the series-resonance frequency of the first, second, and fourth linear antenna elements and lower than the series-resonance frequency of the first and third linear antenna elements.

2. An apparatus according to claim 1, wherein the third and fourth linear antenna elements are arranged parallel to each other.

3. An apparatus according to claim 1, wherein the first, second, third, and fourth linear antenna elements include wire elements, and the connection element includes a planar element.

4. An apparatus according to claim 1, wherein the first, second, third, and fourth linear antenna elements and the connection element include wire elements.

5. An apparatus according to claim 1, wherein the first, second, third, and fourth linear antenna elements and the connection element include ribbon elements.

6. A radio apparatus comprising:

an antenna apparatus comprising a feed point, a first linear antenna element which has one end connected to the feed point, a second linear antenna element which has one end connected to the other end of the first linear antenna element, a third linear antenna element which has one end connected to the other end of the first linear antenna element, a fourth linear antenna element which has one end connected to the other end of the second linear antenna element, and a connection element which connects the other end of the second linear antenna element and a ground terminal, wherein a sum of lengths of the first, second, and fourth linear antenna elements is ¼ a wavelength corresponding to a series-resonance frequency of the first, second, and fourth linear antenna elements, a sum of lengths of the second, third, and fourth linear antenna elements is ½ a wavelength corresponding to a parallel-resonance frequency of the second, third, and fourth linear antenna elements, a sum of lengths of the first and third linear antenna elements is ¼ a wavelength corresponding to a series-resonance frequency of the first and third linear antenna elements, and the parallel-resonance frequency is higher than a frequency of the series-resonance frequency of the first, second, and fourth linear antenna elements and lower than the series-resonance frequency of the first and third linear antenna elements; and a radio circuit which is connected to the feed point and transmits and receives a radio wave via the antenna comprised the first, second, third, and fourth linear antenna elements.

7. An antenna apparatus comprising:

a feed point;

a first linear antenna element which has one end connected to the feed point;

a second linear antenna element which has one end connected to the other end of the first linear antenna element;

a third linear antenna element which has one end connected to the other end of the first linear antenna element and is arranged on the same plane as the second linear antenna element; and a connection element which connects the other end of the first linear antenna element and a ground terminal, wherein a sum of lengths of the first and third linear antenna elements is ¼ a wavelength corresponding to a series-resonance frequency of the first and third linear antenna elements, a sum of lengths of the second and third linear antenna elements is ½ a wavelength corresponding to a parallel-resonance frequency of the second and third linear antenna elements, a sum of lengths of the first and second linear antenna elements is ¼ a wavelength corresponding to a series-resonance frequency of the first and second linear antenna elements, and the parallel-resonance frequency is higher than the series-resonance frequency of the first and third linear antenna elements and lower than the series-resonance frequency of the first and second linear antenna elements.

8. An apparatus according to claim 7, wherein the first, second, and third linear antenna elements include wire antenna elements, and the connection element includes a planar antenna element.

9. An apparatus according to claim 7, wherein the first, second, and third linear antenna elements and the connection element include wire antenna elements.

10. An apparatus according to claim 7, wherein the first, second, and third linear antenna elements and the connection element include ribbon antenna elements.

11. A radio apparatus comprising:

an antenna apparatus comprising a feed point, a first linear antenna element which has one end connected to the feed point, a second linear antenna element which has one end connected to the other end of the first linear antenna element, a third linear antenna element which has one end connected to the other end of the first linear antenna element and is arranged on the same plane as the second linear antenna element, and a connection element which connects the other end of the first linear antenna element and a ground terminal, wherein a sum of lengths of the first and third linear antenna elements is ¼ a wavelength corresponding to a series-resonance frequency of the first and third linear antenna elements, a sum of lengths of the second and third linear antenna elements is ½ a wavelength corresponding to a parallel-resonance frequency of the second and third linear antenna elements, a sum of lengths of the first and second linear antenna elements is ¼ a wavelength corresponding to a series-resonance frequency of the first and second linear antenna elements, and the parallel-resonance frequency is higher than the series-resonance frequency of the first and third linear antenna elements and lower than the series-resonance frequency of the first and second linear antenna elements; and a radio circuit which is connected to the feed point and transmits and receives a radio wave via the antenna comprised the first, second, and third linear antenna elements.

12. An antenna apparatus comprising:

a feed point;

a first linear antenna element which has one end connected to the feed point;

a second linear antenna element which has one end connected to the other end of the first linear antenna element;

a third linear antenna element which has one end connected to the other end of the second linear antenna element; and a connection element which connects the other end of the second linear antenna element and a ground terminal, wherein a sum of lengths of the first, second, and third linear antenna elements is ¼ a wavelength corresponding to a series-resonance frequency of the first, second, and third linear antenna elements, a sum of lengths of the second and third linear antenna elements is ½ a wavelength corresponding to a parallel-resonance frequency of the second and third linear antenna elements, a length of the first linear antenna element is ¼ a wavelength corresponding to a series-resonance frequency of the first linear antenna element, and the parallel-resonance frequency is higher than the series-resonance frequency of the first, second, and third linear antenna elements and lower than the series-resonance frequency of the first linear antenna element.

13. An apparatus according to claim 12, wherein the first, second, and third linear antenna elements include wire antenna elements, and the connection element includes a planar antenna element.

14. An apparatus according to claim 12, wherein the first, second, and third linear antenna elements and the connection element include wire antenna elements.

15. An apparatus according to claim 12, wherein the first, second, and third linear antenna elements and the connection element include ribbon antenna elements.

16. A radio apparatus comprising:

an antenna apparatus comprising a feed point, a first linear antenna element which has one end connected to the feed point, a second linear antenna element which has one end connected to the other end of the first linear antenna element, a third linear antenna element which has one end connected to the other end of the first linear antenna element, a fourth linear antenna element which has one end connected to the other end of the first linear antenna element, a fifth linear antenna element which has one end connected to the other end of the second linear antenna element, a sixth linear antenna element which has one end connected to the other end of the second linear antenna element, and a connection element which connects the other end of the second linear antenna element and a ground terminal, in which an axis of the first linear antenna element coincides with an axis of the second linear antenna element, a division line which halves an angle defined by the third and fourth linear antenna elements and a division line which halves an angle defined by the fifth and sixth linear antenna elements are directed to the same direction, the lengths of the third and fourth linear antenna elements are equal to each other, and the lengths of the fifth and sixth linear antenna elements are equal to each other; and a radio circuit which is connected to the feed point and transmits and receives a radio wave via the antenna comprised the first, second, third, fourth, fifth, and sixth linear antenna elements.

17. An antenna apparatus comprising:

a feed point;

a first linear antenna element which has one end connected to the feed point;

a second linear antenna element which has one end connected to the other end of the first linear antenna element;

a third linear antenna element which has one end connected to the other end of the first linear antenna element;

a fourth linear antenna element which has one end connected to the other end of the first linear antenna element;

a fifth linear antenna element which has one end connected to the other end of the second linear antenna element;

a sixth linear antenna element which has one end connected to the other end of the second linear antenna element; and a connection element which connects the other end of the second linear antenna element and a ground terminal, in which an axis of the first linear antenna element coincides with an axis of the second linear antenna element, a division line which halves an angle defined by the third and fourth linear antenna elements and a division line which halves an angle defined by the fifth and sixth linear antenna elements are directed to the same direction, the lengths of the third and fourth linear antenna elements are equal to each other, and the lengths of the fifth and sixth linear antenna elements are equal to each other.

18. An apparatus according to claim 17, wherein the sum of the lengths of the first, second, and fifth linear antenna elements is ¼ the wavelength corresponding to a series-resonance frequency of the first, second, and fifth linear antenna elements, the sum of the lengths of the first, second, and sixth linear antenna elements is ¼ the wavelength corresponding to a series-resonance frequency of the first, second, and sixth linear antenna elements, the sum of the lengths of the second, third, and fifth linear antenna elements is ¼ the wavelength corresponding to a parallel-resonance frequency of the second, third, and fifth linear antenna elements, and the sum of the lengths of the second, fourth, and sixth linear antenna elements is ½ the wavelength corresponding to a parallel-resonance frequency of the second, fourth, and sixth linear antenna elements.

19. An apparatus according to claim 17, wherein the third and fifth linear antenna elements are arranged parallel to each other, and the fourth and sixth linear antenna elements are arranged parallel to each other.

20. An apparatus according to claim 17, wherein the third and fourth linear antenna elements are arranged on the same plane, and the fifth and sixth linear antenna elements are arranged on the same plane different from the plane on which the third and fourth linear antenna elements are arranged.

21. An apparatus according to claim 17, wherein the first, second, third, fourth, fifth, and sixth linear antenna elements include wire antenna elements, and the connection element includes a planar antenna element.

22. An apparatus according to claim 17, wherein the first, second, third, fourth, fifth, and sixth linear antenna elements and the connection element include wire antenna elements.

23. An apparatus according to claim 17, wherein the first, second, third, fourth, fifth, and sixth linear antenna elements and the connection element include ribbon antenna elements.

* * * * *